US009964048B2

(12) United States Patent
Tipton et al.

(10) Patent No.: US 9,964,048 B2
(45) Date of Patent: May 8, 2018

(54) SYSTEMS AND METHODS FOR ADAPTIVE THROTTLE FILTERING

(71) Applicant: Caterpillar Inc., Peoria, IL (US)

(72) Inventors: Scott Tipton, East Peoria, IL (US); James Landes, East Peoria, IL (US); Joshua Moon, Edelstein, IL (US); Ryan Anderson, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 275 days.

(21) Appl. No.: 14/810,932

(22) Filed: Jul. 28, 2015

(65) Prior Publication Data

US 2017/0030270 A1 Feb. 2, 2017

(51) Int. Cl.
*F02D 11/10* (2006.01)
*F02D 11/02* (2006.01)

(52) U.S. Cl.
CPC ..... *F02D 11/107* (2013.01); *F02D 11/02* (2013.01); *F02D 2011/101* (2013.01)

(58) Field of Classification Search
CPC .. F02D 11/107; F02D 11/02; F02D 2011/101; F02D 19/024; F02D 2250/32; F02D 2700/02; F02D 2700/0225; F02D 41/0002; B60W 2510/0619; B60W 2710/0622; F02B 19/1052; F02B 19/1085
USPC ..... 123/377, 396, 397, 339.13, 398, 400, 123/360, 361, 403; 701/101, 102, 103, 701/104, 110
See application file for complete search history.

(56) References Cited

U.S. PATENT DOCUMENTS 4,515,126 A 5/1985 Kessler
4,860,210 A 8/1989 McCombie
5,255,653 A * 10/1993 Ironside ..... F02D 11/105 123/198 D
5,775,293 A 7/1998 Kresse
6,038,504 A 3/2000 Cronin et al.
6,167,979 B1 1/2001 Taylor et al.
6,278,986 B1 * 8/2001 Kamihira ..... F02D 41/1401 701/101
6,304,806 B1 10/2001 Colby et al.
7,958,779 B2 * 6/2011 Nagano ..... F02D 41/0097 73/114.15
8,260,521 B2 9/2012 Sato
8,442,720 B2 * 5/2013 Lu ..... B60T 8/172 280/5.501
8,600,640 B2 * 12/2013 Shoemaker ..... F02D 11/02 340/855.4
8,775,040 B2 * 7/2014 Noumura ..... B60W 30/02 136/256

(Continued)

*Primary Examiner* — Lindsay Low
*Assistant Examiner* — John Bailey
(74) *Attorney, Agent, or Firm* — Baker Hostetler; James S. Bennin

(57) ABSTRACT

Systems and methods for adaptive throttle filtering are disclosed. One method includes receiving vertical acceleration data indicative of a plurality of vertical accelerations of a machine, receiving first throttle pedal data indicative of a plurality of throttle pedal movements, determining a filter factor based at least on the vertical acceleration data, filtering the first throttle pedal data, based at least on the filter factor, to determine second throttle pedal data, and causing the second throttle pedal data to be transmitted to a controller to effectuate control of an operation of an engine.

18 Claims, 13 Drawing Sheets

(56) References Cited

U.S. PATENT DOCUMENTS

| | | | | |
|---|---|---|---|---|
| 9,644,559 | B2 * | 5/2017 | Pedro | F02D 41/1497 |
| 2009/0265058 | A1 * | 10/2009 | Hasegawa | F02D 29/02 701/31.4 |
| 2011/0022286 | A1 * | 1/2011 | Sato | B60K 26/02 701/99 |
| 2011/0202235 | A1 * | 8/2011 | Oikawa | B60W 30/20 701/36 |
| 2012/0143392 | A1 * | 6/2012 | Lurie | B64C 13/04 701/1 |
| 2012/0143399 | A1 * | 6/2012 | Noumura | B60W 30/02 701/1 |
| 2012/0303231 | A1 * | 11/2012 | Noumura | F02D 11/105 701/70 |
| 2013/0325227 | A1 | 12/2013 | Whitney et al. | |

* cited by examiner

SYSTEMS AND METHODS FOR ADAPTIVE THROTTLE FILTERING

TECHNICAL FIELD

This disclosure relates generally to engine throttle control, and more particularly to systems and methods for adaptive throttle filtering.

BACKGROUND

The engine of a machine, such as a hauling truck at a mine site, is typically controlled according to operator input via the throttle pedal. In particular, the desired power demands of the operator are inputted by the operator causing movements of the throttle pedal (e.g., the throttle pedal is depressed to increase the speed of the engine and/or request more power from the engine). However, conditions in which a machine operates may cause unintended throttle pedal movements. For example, rough terrain may cause the operator to inadvertently depress the throttle pedal. Such unintended throttle movements may cause undesirable engine behavior, degrade fuel economy, increase gear hunting, and degrade shift quality.

U.S. Pat. No. 8,260,521 to Sato (the '521 patent) discloses a system that allegedly addresses the problem of unintentional throttle pedal movements. In the '521 patent, the disclosed system uses a vibration sensor to detect a vertical vibration of a machine. If a vertical vibration is detected, a correcting value is determined based on the vertical vibration. The correcting value is then added or subtracted to the throttle pedal movement to compensate for the vertical vibration. The adjusted throttle pedal movement is then communicated to the engine. While the system of the '521 patent may purport to address the problem of compensating for unintentional throttle pedal movements caused by vertical vibrations, the computation of the correcting value for every throttle pedal movement may impose substantial computational requirements. Accordingly, there is a need for an improved system for address the aforementioned problem and/or other problems in the art.

SUMMARY

This disclosure relates to systems and methods for adaptive throttle filtering. One method includes receiving vertical acceleration data indicative of a plurality of vertical accelerations of a machine, receiving first throttle pedal data indicative of a plurality of throttle pedal movements, determining a filter factor based at least on the vertical acceleration data, filtering the first throttle pedal data, based at least on the filter factor, to determine second throttle pedal data, and causing the second throttle pedal data to be transmitted to a controller to effectuate control of an operation of an engine.

In an aspect, a method includes receiving first throttle pedal data indicative of a first plurality of throttle pedal movements, filtering the first throttle pedal data to determine second throttle pedal data indicative of a second plurality of throttle pedal movements, determining a throttle error based at least on a comparison of the first throttle pedal data to the second throttle pedal data, determining a filter factor based at least on the throttle error, filtering the first throttle pedal data, based at least on the filter factor, to determine third throttle pedal data, and causing the third throttle pedal data to be transmitted to a controller to effectuate control of an operation of an engine.

In an aspect, a method includes receiving first throttle pedal data indicative of a first plurality of throttle pedal movements, receiving vertical acceleration data indicative of a plurality of vertical accelerations of a machine, determining a vertical acceleration filter factor based at least on the vertical acceleration data, filtering the first throttle pedal data to determine second throttle pedal data indicative of a second plurality of throttle pedal movements, determining a throttle error based at least on a comparison of the first throttle pedal data and the second throttle pedal data, determining a throttle error filter factor based at least on the throttle error, determining a filter factor based at least on the throttle error filter factor and the vertical acceleration filter factor, filtering the first throttle pedal data, based at least on the filter factor, to determine third throttle pedal data, and causing the third throttle pedal data to be transmitted to a controller to effectuate control of an operation of an engine.

BRIEF DESCRIPTION OF THE DRAWINGS

The following detailed description is better understood when read in conjunction with the appended drawings. For the purposes of illustration, examples are shown in the drawings; however, the subject matter is not limited to the specific elements and instrumentalities disclosed. In the drawings.

DETAILED DESCRIPTION

Figure 1:
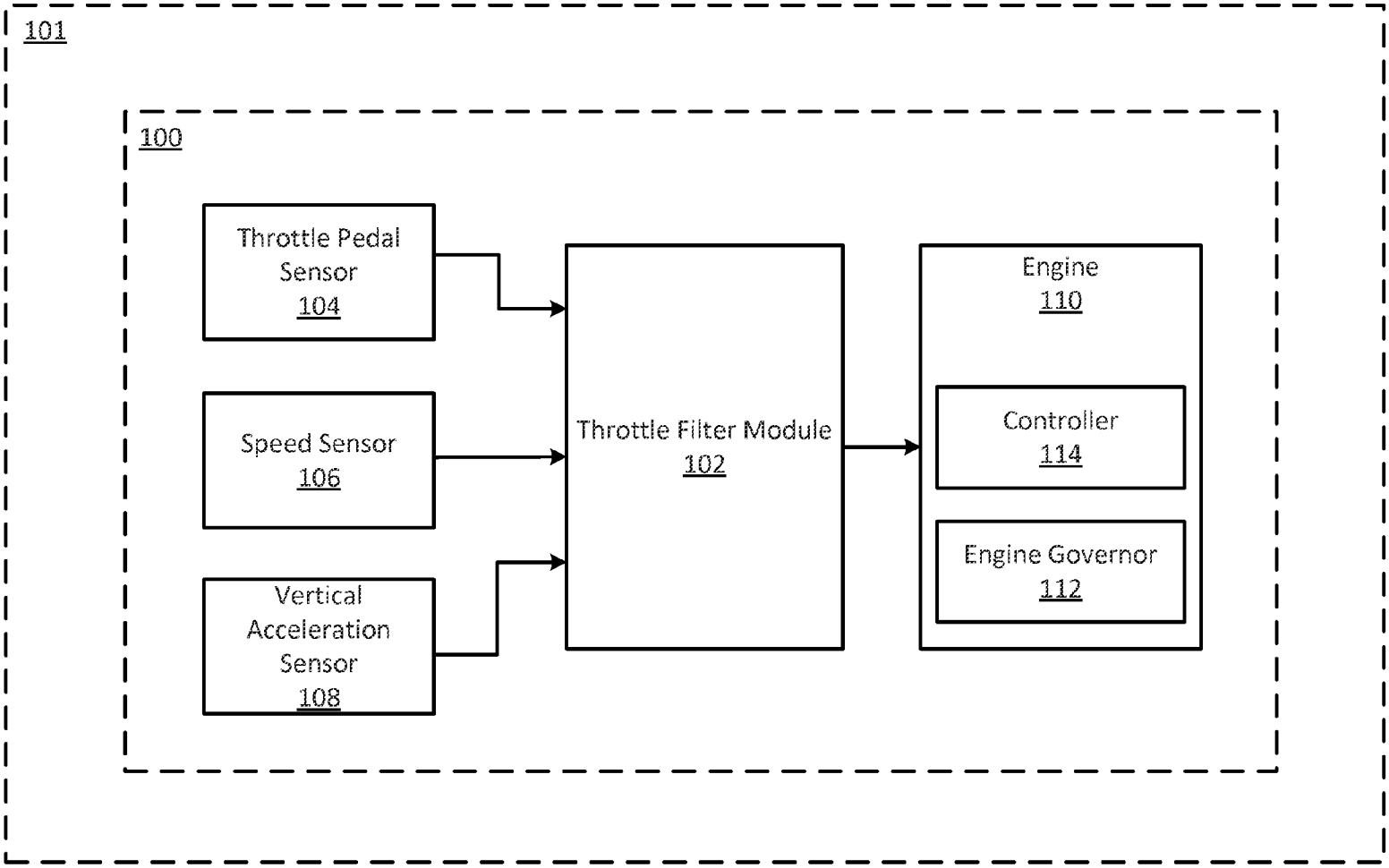
FIG. 1 illustrates a schematic view of an exemplary machine including an exemplary throttle system in accordance with aspects of the disclosure.

FIG. 1 illustrates a machine 101 including a throttle system 100 in accordance with aspects of the disclosure. The throttle system 100 may include a throttle filter module 102 in which one or more throttle pedal inputs, such as from a throttle pedal sensor 104, may be filtered according to various aspects of the disclosure. The throttle filter module 102 may additionally receive other inputs, such as from a speed sensor 106 and/or a vertical acceleration sensor 108. The throttle filter module 102 may be disposed within the machine 101 having an engine 110. The machine 101 may include a heavy machine, such as a truck, an excavator, a track-type tractor, or a wheel loader.

The engine 110 may be any type of engine, including an internal combustion engine (including a gasoline engine or diesel engine) or electric engine. The engine 110 may include an engine governor 112 that measures and controls the speed (i.e., the revolutions per minute (RPM)) at which the engine 110 operates. The engine governor 112 may be responsive to inputs, such as a throttle pedal input reflective of a machine operator's desire to increase the power output of the engine 110 and, thus, the speed of the machine 101. The engine may further include a controller 114, such as an electronic control unit (ECU), which may sometimes be referred to as an electronic control module (ECM). The controller 114 may comprise a memory and a processor configured to effectuate instructions relating to various aspects of the operation of the engine 110, such as control of the air/fuel ratio, ignition timing, and/or valve timing. The engine governor 112 may be implemented as part of the controller 114.

As used throughout the disclosure, the term "throttle" is to be understood as generally referring to any system, including logical, mechanical, or a combination thereof, by which the power and/or speed of the engine 110 may be regulated. For example, a throttle in a gasoline engine may include a system having a valve that regulates an amount of air entering the gasoline engine, and thus controlling the power output and/or speed of the gasoline engine. As another example, a throttle in a diesel engine may include a system that regulates the quantity of diesel fuel that is injected into each cylinder of the diesel engine.

The throttle filter module 102 may be communicatively and/or operatively connected to the engine 110 or component thereof (e.g., the engine governor 112 and/or the controller 114) to transmit one or more throttle pedal inputs received from a throttle pedal sensor 104. The throttle filter module 102 may be implemented as a logical module within a computing device, having a processor and memory, disposed within the machine 101. In an aspect, the throttle filter module 102 may be implemented as a logical module in the controller 114 of the engine 110. In another aspect, the throttle filter module 102 may be implemented as a logical module in a transmission control unit (TCU) that monitors and controls the operation of a transmission of the machine 101. In yet another aspect, the throttle filter module 102 may be implemented within a computing device discrete from the controller 114 or TCU of the machine 101.

The throttle filter module 102 may be communicatively connected to the throttle pedal sensor 104 in order to receive one or more throttle pedal inputs. The throttle pedal sensor 104 may be part of a throttle pedal system including a throttle pedal and the throttle pedal sensor 104. The throttle pedal sensor 104 may include a potentiometer or a Hall effect sensor, as some examples. One or more positions or movements of the throttle pedal may be detected, recorded, stored and/or transmitted by the throttle pedal sensor 104 as the throttle pedal input. For example, the throttle pedal input may include one or more sequential data points, wherein each data point represents the position of the throttle pedal at a particular moment of time. As the data points represent the sequential positions of the throttle pedal, the throttle pedal input may represent one or more movements of the throttle pedal, such as the throttle pedal being depressed from a first position to a second position, and the throttle pedal then being allowed to rise back up to the first position or vice versa.

The throttle filter module 102 may be communicatively connected to the speed sensor 106 configured to receive one or more speeds. The speed sensor 106 may detect, record, store, and/or transmit one or more data points correlating to or representing the speed of the machine 101. The speed sensor 106 may include any type of sensor capable of measuring the speed of the machine 101 or data which may be correlated with the speed of the machine 101. For example, the speed sensor 106 may include a transmission output speed sensor or a wheel speed sensor.

The throttle filter module 102 may further be communicatively connected to a vertical acceleration sensor 108. The vertical acceleration sensor 108 may detect, store, record, and/or transmit vertical accelerations of the machine 101. For example, the machine 101 going over a bump or a series of bumps on a rough road may undergo one or more vertical accelerations that may be detected by the vertical acceleration sensor 108. The vertical acceleration sensor 108 may include an accelerometer or an inertial measurement unit (IMU).

Figure 2:
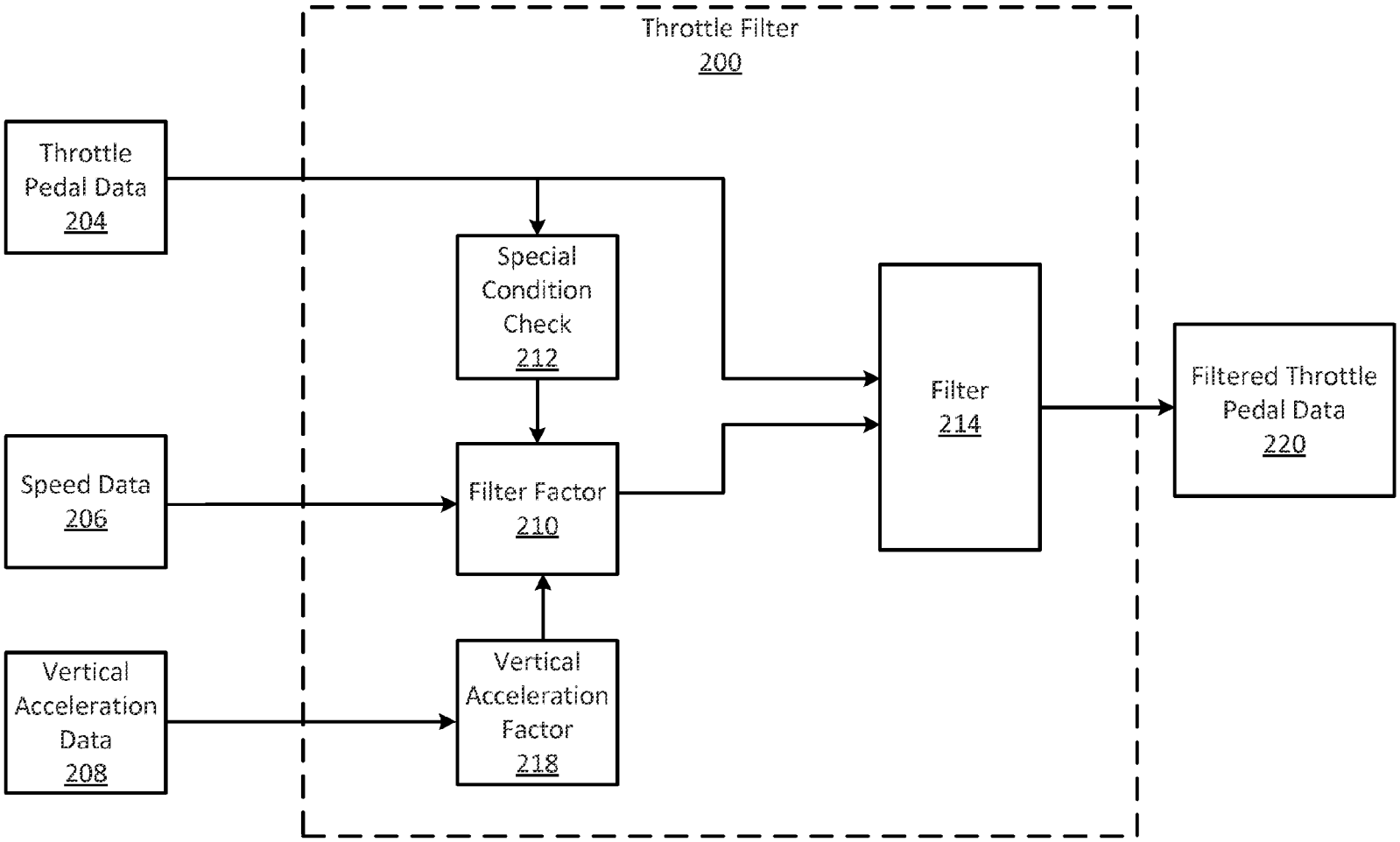
FIG. 2 illustrates a block diagram of an exemplary data flow in accordance with aspects of the disclosure.

FIG. 2 depicts an example flow diagram of various operations relating to systems and methods of adaptive throttle filtering. In an aspect, a throttle filter 200 may receive throttle pedal data 204, such as data representing one or more throttle pedal movements, and filter the throttle pedal data 204 based on speed data 206 and/or vertical acceleration data 208. The throttle filter 200 may be implemented in the throttle filter module 102.

Figure 3:
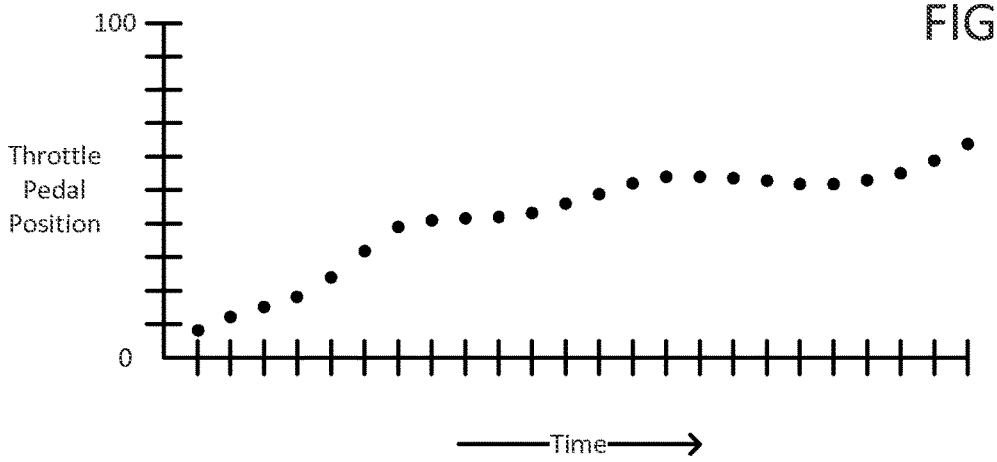
FIG. 3 illustrates a graph of data points comprising throttle pedal data in accordance with aspects of the disclosure.

The throttle pedal data 204 may be received from the throttle pedal sensor 104 and may include data representing one or more positions and/or movements of the throttle pedal. The throttle pedal data 204 may include a plurality of sequential data points each representing a position of the throttle pedal at a corresponding point in time. For example, FIG. 3 depicts a graph showing throttle pedal data 204 comprising a plurality of sequential data points, wherein each data point is plotted according to throttle pedal position and time. Each of the data points shown in FIG. 3 represents the position of the throttle pedal at a series of discrete moments in time. The throttle pedal position may be represented by a metric indicating the relative degree of depression of the throttle pedal. For instance, the throttle pedal position may be represented by a value between 0 and 100, where 0 represents no throttle pedal depression (e.g., the operator has his or her foot off the pedal) and 100 represents maximum throttle pedal depression (e.g., the operator has depressed the pedal to the maximum extent permitted by the machine 101). Since the throttle pedal data 204 may comprise a plurality of sequential data points each representing a throttle pedal positions at a point in time, throttle pedal movements (i.e., a change in throttle pedal position over a period of time) may be determined and thus be considered as part of the throttle pedal data 204.

Figure 4:
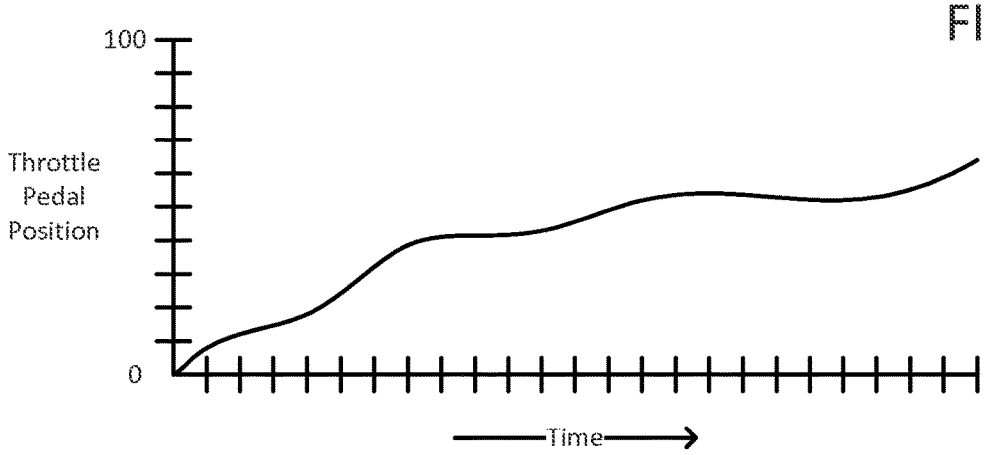
FIG. 4 illustrates a graph of a throttle pedal position signal comprising throttle pedal data in accordance with aspects of the disclosure.

The throttle pedal data 204 may further be represented as a signal. The plurality of sequential data points each representing the throttle pedal positions may be linearly interpolated, such as via a curve fitting or regression analysis method, to form a signal. For example, FIG. 4 shows a graph with a signal representing the interpolation of the plurality of data points shown in FIG. 3.

Referring back to FIG. 2, the speed data 206 may include data representing the speed of the machine 101 and may be received from the speed sensor 106 and/or derived from data from the speed sensor 106. For example, the speed sensor 106 may detect and transmit the wheel speed, which in turn may be translated into a machine speed. As an example, the speed data 206 may indicate the velocity, for example in miles per hour, that the machine 101 is traveling.

The vertical acceleration data 208 may include data representing one or more vertical accelerations of the machine 101. The vertical acceleration data 208 may be received from the vertical acceleration sensor 108. As an example, the up-and-down accelerations caused by the machine 101 traveling over a bumpy road may be represented in the vertical acceleration data 208. The vertical acceleration data 208 may include a plurality of sequential data points, wherein each data point represents a magnitude of vertical acceleration of the machine 101 at a corresponding point in time. The vertical acceleration data 208 may include a signal representing the vertical acceleration of the machine 101 over a period of time. The vertical acceleration signal may be determined by a linear interpolation of the plurality of data points representing the vertical accelerations.

A vertical acceleration factor 218 may be determined and used in the throttle filter 200. The vertical acceleration factor 218 may, generally, represent the frequency and/or magnitude of vertical accelerations experienced by the machine 101. Even more generally, the vertical acceleration factor 218 may reflect a condition, such as the machine 101 passing over rough terrain, that may cause the machine 101 operator to unintentionally depress or release the throttle pedal. The vertical acceleration factor 218 may be based on the vertical acceleration data 208 and may be determined according to various analytics performed on the vertical acceleration data 208. For example, the vertical acceleration signal of the vertical acceleration data 208 may be filtered, such as via a low pass filter. That filtered vertical acceleration signal may be compared to (e.g., subtracted from) the unfiltered vertical acceleration signal to determine a raw error of the vertical acceleration signal. The raw error may be used to determine a mean error. A noise threshold value may be compared to (e.g., subtracted from) the mean error to determine an integral value of the vertical acceleration. The integral value may be used as the vertical acceleration factor 218 or the integral value may be further used to determine the vertical acceleration factor 218. In an aspect, the vertical acceleration factor 218 may be in the form of a value, for example from 0 to 1, wherein 0 indicates no vertical acceleration (e.g., a substantially smooth road) and 1 indicates a large frequency and/or magnitude of vertical accelerations (e.g., very rough and uneven terrain).

A filter factor 210 may be determined based on the speed data 206 and/or the vertical acceleration factor 218. The filter factor 210 may represent the existence of conditions, such as a rough road or unstable terrain, in which it is desirable that the throttle pedal data 204, including one or more data point representing throttle pedal positions, be filtered or filtered to an increased degree. In an aspect, the filter factor 210 may be represented by a value from 0 to 1, wherein a value of 1 indicates that no or minimal filtering of the throttle pedal data 204 is to occur (i.e., no or minimal data representing positions and/or movements of the throttle pedal are filtered out from the throttle pedal data 204) and a value of 0 indicates that the throttle pedal data 204 is to be filtered to a maximum degree (i.e., a large amount of data representing positions and/or movements of the throttle pedal are filtered out from the throttle pedal data 204).

The filter factor 210 may be determined so that the filter factor 210 reflects an increased degree of filtering of the throttle pedal data 204 proportional to the speed of the machine 101, represented in the speed data 206, and/or the frequency and/or amplitude of vertical accelerations experienced by the machine 101, represented in the vertical acceleration data 208 and/or the vertical acceleration factor 218.

As used throughout this disclosure, the term "proportional" should be generally taken to mean a correspondence between a first element and a second element. For example, "proportional" may indicate that as a value of a first element increases, a value of a second element increases. In other instances, "proportional" may indicate that as a value of first element increases, a value of a second element decreases. "Proportional" may refer to liner proportionality or non-linear proportionality.

With respect to the vertical accelerations experienced by the machine 101, which may be detected by the vertical acceleration sensor 108, the filter factor 210 may be determined so that the degree of filtering indicated by the filter factor 210 is proportional to the vertical acceleration data 208 and/or the vertical acceleration factor 218. For example, if the vertical acceleration data 208 and/or the vertical acceleration factor 218 indicate a large number of significant vertical accelerations within a period of time, the filter factor 210 associated with that period of time may indicate that the throttle pedal data 204 is to be heavily filtered for that period of time. Conversely, if the vertical acceleration data 208 and/or the vertical acceleration factor 218 indicate minimal or no vertical accelerations within a period of time, the filter factor 210 associated with that period of time may indicate that the throttle pedal data 204 is to remain unfiltered or only minimally filtered before being passed to the engine 110.

The determination of the filter factor 210 may be based, at least, on the vertical acceleration data 208 and/or the vertical acceleration factor 218 and may include a reference to a table pairing one or more aspects of the vertical acceleration data 208 and/or the vertical acceleration factor 218, such as the frequency and/or amplitudes of the vertical accelerations or the integral of the vertical acceleration factor 218, with potential values of the filter factor 210. The determination of the filter factor 210 may include the use of a formula or equation in which one or more aspects of the vertical acceleration data 208 and/or the vertical acceleration factor 218 may be input to arrive at the filter factor 210.

With respect to the machine speed, which may be determined by the speed sensor 106, the filter factor 210 may be determined so that the degree of filtering indicated by the filter factor 210 is proportional to the machine speed represented in the speed data 206. For instance, if the machine 101 is traveling at a high speed, the filter factor 210 may indicate that the throttle pedal data 204 is to be heavily filtered. On the other hand, if the machine 101 is traveling at a low speed, the filter factor 210 may indicate that the throttle pedal data 204 is not to be filtered or only minimally filtered.

The determination of the filter factor 210 may be based, at least, on the machine speed of the speed data 206 and may include a reference to a table pairing one or more aspects of the speed data 206, such as the machine speed, with potential values of the filter factor 210. The determination of the filter factor 210 based, at least, on the machine speed of the speed data 206 may further include the use of a formula or equation in which one or more aspects of the speed data 206 may be input to determine the filter factor 210.

Figure 5:
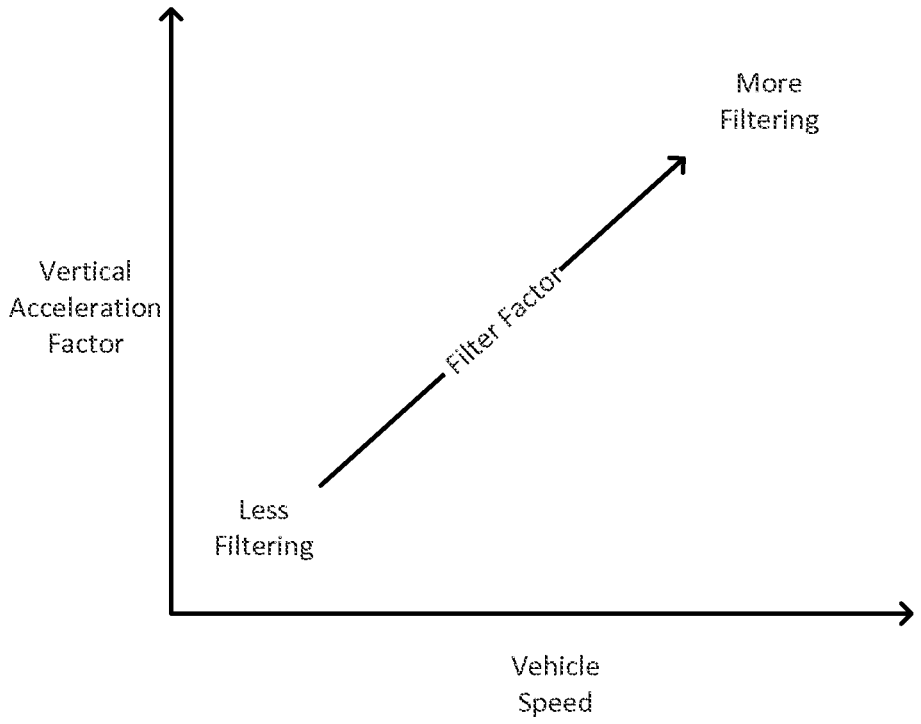
FIG. 5 illustrates a graph showing a methodology of determining a filter factor in accordance with aspects of the disclosure.

In an aspect, the determination of the filter factor 210 may be based, at least, on both the machine speed of the speed data 206 and the vertical accelerations of the vertical acceleration data 208 and/or the vertical acceleration factor 218. FIG. 5 depicts a graph in which the vertical acceleration factor 218 is plotted against the machine speed of the speed data 206 to determine the filter factor 210. As shown in FIG. 5, as the vertical acceleration factor 218 increases (i.e., the frequency and/or amplitude of the vertical accelerations increases), the filter factor 210 may be determined to indicate an increased degree of filtering. For example, if the filter factor 210 includes a value from 0 to 1, where 0 is the highest degree of filtering and 1 is the lowest degree of filtering, as the vertical acceleration factor 218 increases, the filter factor 210 would move towards a value of 0. As the machine speed of the speed data 206 increases, the filter factor 210 may be determined to indicate an increased degree of filtering. Accordingly, when the vertical acceleration factor 218 and the machine speed of the speed data 206 are both high, a high degree of filtering may be indicated by the filter factor 210. Conversely, when the vertical acceleration factor 218 and the machine speed of the speed data 206 are both low, a low degree of filtering may be indicated by the filter factor 210.

Referring again to FIG. 2, in an aspect, the filter factor 210 may be additionally based on a special condition check 212. The special condition check 212 may determine if one or more of several special conditions exist, in which case the filter factor 210 may be determined accordingly. One such special condition may be if the throttle pedal data 204 indicates a throttle pedal position of slight depression, such as if the operator is only lightly touching the throttle pedal. For example, this special condition may be implicated if the throttle position is at a position of 5 or below on a scale of 0 to 100, where 0 indicates no throttle pedal depression and 100 indicates full throttle pedal depression. Another special condition may be if the throttle pedal data 204 indicates a throttle position almost fully depressed, such as if the operator presses the throttle pedal to the floor of the machine 101. As an example, this special condition may be implicated if the throttle position is at a position of 95 or above on a on a scale of 0 to 100, where 0 indicates no throttle pedal depression and 100 indicates full throttle pedal depression. Yet another special condition may be if brake data indicates that the operator is depressing the brake pedal of the machine 101. In each of the three example special conditions described (light throttle pedal depression, heavy throttle pedal depression, or brake pedal depression), the filter factor 210 may be determined to indicate no or minimal filtering. This may reflect, in the case of heavy throttle pedal depression, for instance, that when the operator is apparently requesting full engine power, it would be undesirable to filter the resulting throttle pedal data 204 and negatively affect the responsiveness to the operator's input.

The throttle pedal data 204 may be filtered by the filter 214 based on the filter factor 210. As described above, the filter factor 210 may indicate a condition, such as rough terrain or loose underfoot conditions, in which the position of the throttle pedal may have been unintentionally affected by the condition. When the filter factor 210 represents such a condition, one or more data points of the throttle pedal data 204 representing throttle pedal positions or movements may be filtered out (i.e., removed or discarded) from the throttle pedal data 204. The resultant data points of the throttle pedal data 204 that are not filtered from the throttle pedal data 204 may be referred to as the filtered throttle pedal data 220. The filtered throttle pedal data 220 may be transmitted to the engine 110 or component thereof, such as the controller 114 or the engine governor 112, to effectuate operation of the engine 110.

To effectuate the filtering process, for example, the filter 214 may determine a first set of throttle pedal data from the throttle pedal data 204 and a second set of throttle pedal data from the throttle pedal data 204, wherein each data point of the throttle pedal data 204 is determined to be in either the first set of throttle pedal data or the second set of throttle pedal data. The first set of throttle pedal data (of which the filtered throttle pedal data 220 may comprise) may be transmitted to the engine 110, or a component thereof, while the second set of throttle pedal data may be discarded. The determination of the first and second sets of throttle pedal data may be based on the filter factor 210. For example, if the filter factor 210 indicates that heavy filtering should be applied to the throttle pedal data 204, a majority of the data points of the throttle pedal data 204 may be determined to be in the second set of throttle pedal data and, therefore, a minority of the data points of the throttle pedal data 204 may be determined to be in the first set of throttle pedal data that is transmitted to the engine 110 as the filtered throttle pedal data 220. In other words, a majority of the data points of the throttle pedal data 204 are filtered out and not passed to the engine 110. Conversely, if the filter factor 210 indicates that minimal or no filtering should be applied to the throttle pedal data 204, a majority of the data points of the throttle pedal data 204 may be determined to be in the first set of throttle pedal data and transmitted to the engine 110 as the filtered throttle pedal data 220 and a minority of the data points of the throttle pedal data 204 may be determined to be in the second set of throttle pedal data and discarded.

Alternatively, or in combination with the above-described filtering process, the filtering process may be effectuated, for example, by modifying, such as by the filter 214, the throttle pedal data 204. The modification may be based on the filter factor 210. As an example, if the filter factor 210 indicates that the throttle pedal data 204 should be heavily filtered during a time interval due to a determination of a number of vertical accelerations embodied in the vertical acceleration data 208 for the time interval, one or more data points of the throttle pedal data 204 may be altered to represent a different throttle pedal position. The modified throttle pedal data may comprise the filtered throttle pedal data 220 and may be sent to the engine 110 to effectuate operation of the engine 110.

To provide a basic illustration, the throttle pedal data 204 may include a first, second, and third data point, each representing a throttle pedal position at sequential points of time. If the vertical acceleration data 208 indicates a large vertical acceleration, such as one that may cause the operator to inadvertently depress the throttle pedal, at the time point corresponding to the second data point, the second data point may be altered to reflect a different throttle pedal position. For example, the second data point may be altered to equal the first data point or the third data point. As another example, the second data point may be altered to comprise an average of any combination of the first, second, and/or third data points (e.g., the average of the first and second data points, the average of the first and third data points, and so forth). As yet another example, the second data point may be altered to comprise an average, such as a rolling average, of the second data point and a certain number of temporally preceding data points. The number of temporally preceding data points may be based on the filter factor 210. The average may be weighted based on the filter factor 210. The first data point, the altered second data point, and the third data point may comprise the filtered throttle pedal data 220 and may be sent to the engine 110.

In an aspect, the filter 214 may include a low-pass filter in which throttle pedal movements embodied in the throttle pedal data 204 with frequencies above a corner frequency are attenuated or filtered out (i.e., are not included in the filtered throttle pedal data 220) and throttle pedal movements at or below the corner frequency are not filtered out (i.e., are included in the filtered throttle pedal data 220). The corner frequency may be determined according to the filter factor 210. In an example aspect, the corner frequency may be determined according to the following table:

TABLE 1

| Filter Factor | Corner Frequency |
|---|---|
| .488408 | 10.667 Hz |
| .395077 | 8 Hz |
| .314078 | 6 Hz |
| .222232 | 4 Hz |
| .118089 | 2 Hz |
| .060899 | 1 Hz |
| .030928 | .5 Hz |
| .010003 | .16 Hz |

Figure 6:
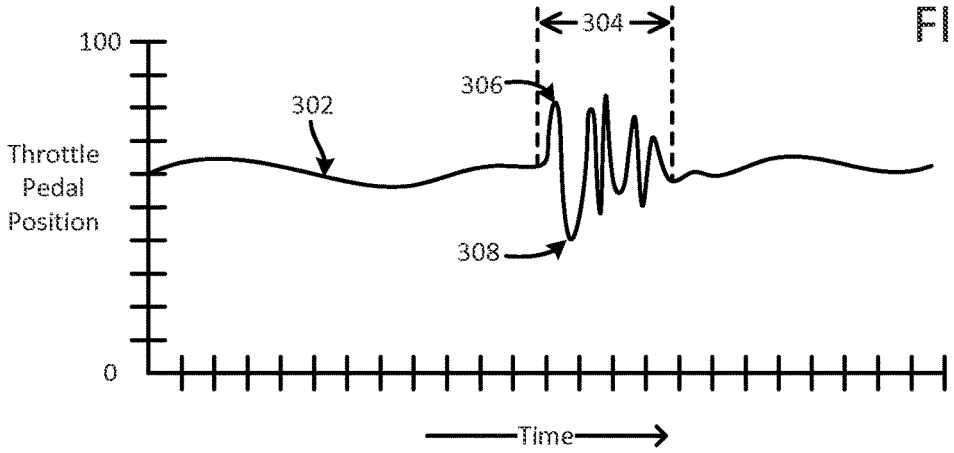
FIG. 6 illustrates a graph showing throttle pedal data in accordance with aspects of the disclosure.
Figure 7:
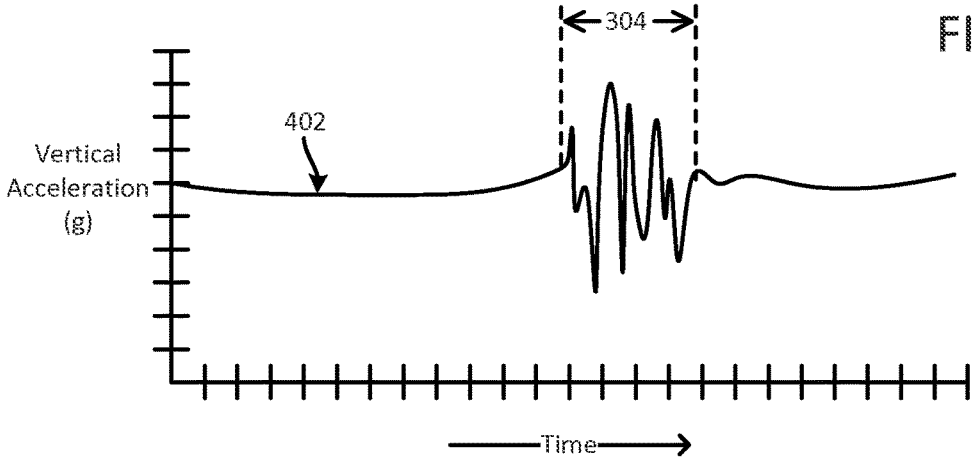
FIG. 7 illustrates a graph showing vertical acceleration data in accordance with aspects of the disclosure.
Figure 8:
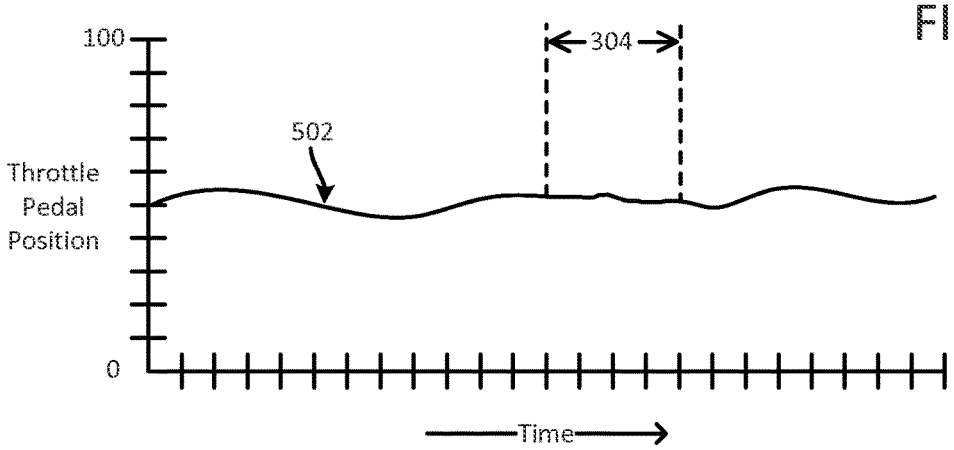
FIG. 8 illustrates a graph showing filtered throttle pedal data in accordance with aspects of the disclosure.

FIGS. 6-8 provide an example of throttle pedal data 204 filtering based, at least, on the vertical acceleration data 208 and/or the vertical acceleration factor 218. FIG. 6 depicts a graph in which a throttle pedal position signal 302, such as a signal embodying the throttle pedal data 204, is plotted according to throttle pedal position and time. During a time interval 304, a number of pronounced, quick movements of the throttle pedal are represented in the throttle pedal position signal 302. For example, the crest 306 may represent a throttle pedal movement in which the operator sharply depressed on the throttle pedal and then quickly released the throttle pedal. The trough 308 may represent a throttle pedal movement in which the operator suddenly released the throttle pedal and then depressed it again, and so forth.

FIG. 7 depicts a graph in which a vertical acceleration signal 402, such as a signal embodying the vertical acceleration data 208 and/or the vertical acceleration factor 218, is plotted according to vertical acceleration and time. In the time interval 304, a number of significant vertical accelerations occur and are represented in the vertical acceleration signal 402. The vertical accelerations in the time interval 304 may have been caused by the machine 101 driving over rough terrain, for example.

FIG. 8 illustrates an example result of the throttle pedal data 204 filtering, such as may occur in the filter 214. The graph in FIG. 8 depicts a filtered throttle pedal position signal 502, such as an embodiment of the filtered throttle pedal data 220. The filtered throttle pedal position signal 502 is derived from filtering the throttle pedal position signal 302 of FIG. 6. Recalling from FIG. 7 that there were a number of significant vertical accelerations in the time interval 304, a filter factor, such as the filter factor 210, may be determined based on the vertical accelerations in the time interval 304. Since the vertical accelerations in the time interval 304 may indicate that the machine 101 passed over rough terrain and, therefore, that the throttle pedal movements embodied in the throttle pedal position signal 302 may have been unintentionally caused by the vertical accelerations of the machine 101, the filter factor may indicate that a heavy amount of filtering should be applied to the throttle pedal position signal 302. The filtering, such as by the filter 214, may filter out one or more of the data points representing throttle pedal movements during the time interval 304. For example, the data points of the crest 306 and the trough 308 of the throttle pedal position signal 302 may be filtered out and omitted from the filtered throttle pedal position signal 502. In an aspect in which the filter process includes a low-pass filter, the frequency of the movements embodied in the crest 306 and the trough 308 may be above a corner frequency determined based on the filter factor. Accordingly, the data points of the crest 306 and trough 308 may be excluded from the filtered throttle pedal position signal 502. The filtering process may continue, whether via low-pass filter or other filter method, for one or more of the other throttle pedals movements of the throttle pedal signal for time interval 304. The heavy filtering indicated by the filter factor in the instant example may result in the relatively flat nature of the filtered throttle pedal position signal 502 during the time interval 304.

It will be appreciated that a time delay may be introduced in the filtering process, such as a time delay caused by the transmitting, processing, and/or filtering of data (e.g., the throttle pedal data 204, the speed data 206, and/or the vertical acceleration data 208). For example, instead of the throttle pedal position signal 302 being filtered, as shown in FIG. 8, during the time interval 304, the throttle pedal position signal 302 may instead be filtered during a later time interval (e.g., the start of the time interval is shifted to the right of the time interval 304 in the graph of FIG. 8) due to the processing time required to determine a filter factor on which the filtering may be based.

Figure 9:
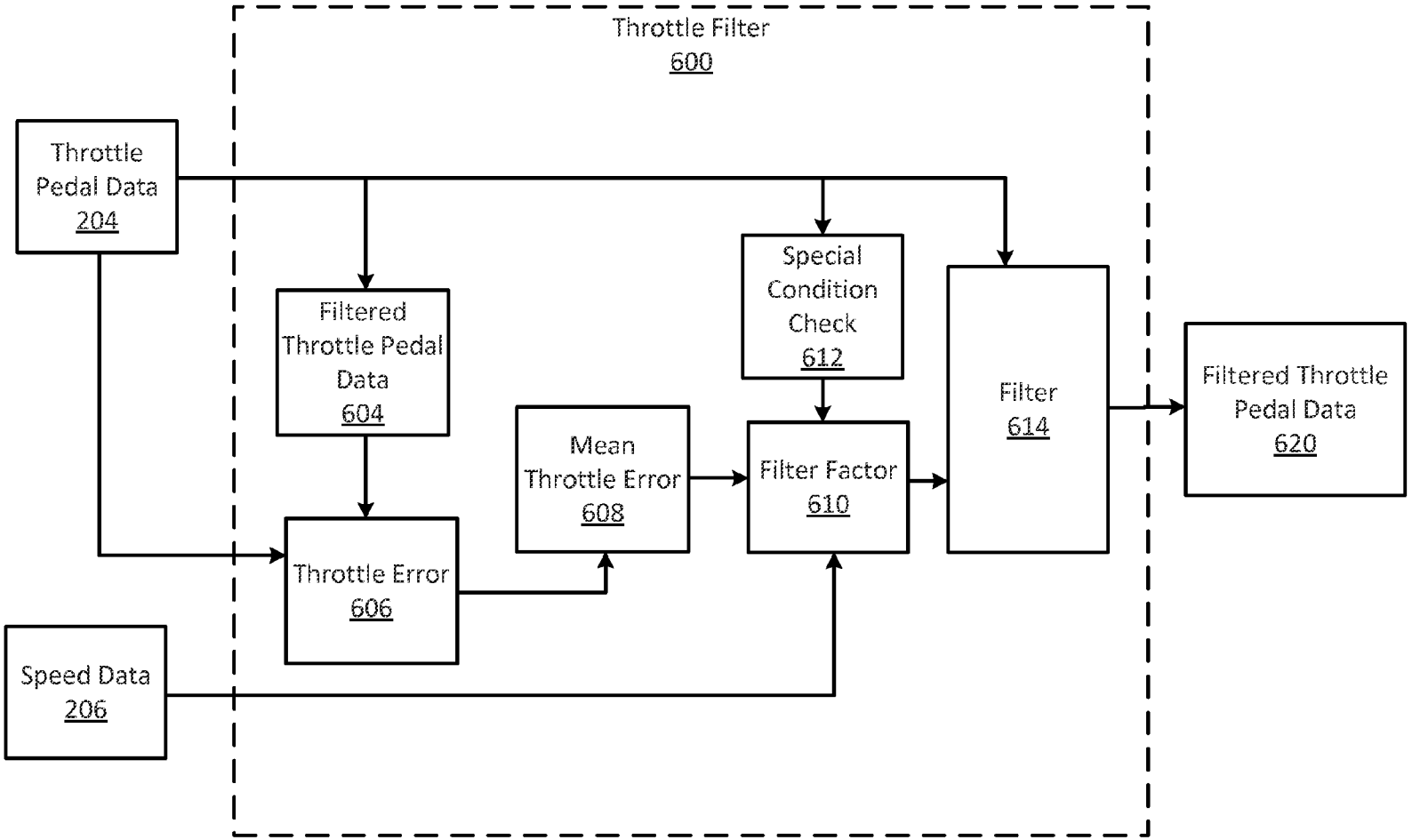
FIG. 9 illustrates a block diagram of an exemplary data flow in accordance with aspects of the disclosure.

FIG. 9 depicts an example flow diagram of various operations relating to systems and methods of adaptive throttle filtering. In an aspect, a throttle filter 600 may receive throttle pedal data 204 and filter the throttle pedal data 204 based on aspects of the throttle pedal data 204, such as a mean throttle error 608, and/or the speed data 206. The throttle filter 600 may identify symmetrical oscillations of the throttle pedal in the throttle pedal data 204 and filter the throttle pedal data 204 to remove or attenuate those symmetrical oscillations. The throttle filter 600 may be implemented in the throttle filter module 102.

As discussed in reference to FIG. 2, the throttle pedal data 204 may include data representing one or more positions and/or movements of the throttle pedal and may be received from the throttle pedal sensor 104. As shown in FIG. 3, the throttle pedal data 204 may be include a plurality of sequential data points, each representing a position of the throttle pedal at a point in time. The throttle pedal data 204 may be represented as a signal, as shown in FIG. 4. Also as discussed in reference to FIG. 2, the speed data 206 may include data representing the speed of the machine 101 and may be received from the speed sensor 106.

The throttle pedal data 204 may be filtered by a filter 614 based on a filter factor 610. The filter factor 610 may be a metric or other indicator that represents the existence of a condition in which one or more throttle pedal positions and/or movements represented in the throttle pedal data 204 may be unintended by the machine operator and, thus, would be desirable to be filtered out (i.e., removed) from a throttle signal sent to the engine 110. Such a condition may be an undulating road that causes the operator to unintentionally depress and release the throttle pedal in symmetric oscillations. In an aspect, the filter factor 610 may be represented by a value from 0 to 1, wherein a value of 1 indicates that no or minimal filtering of the throttle pedal data 204 is to occur (i.e., no or minimal data representing positions and/or movements of the throttle pedal are filtered out from the throttle pedal data 204) and a value of 0 indicates that the throttle pedal data 204 is to be filtered to a maximum degree (i.e., a large amount of data representing positions and/or movements of the throttle pedal are filtered out from the throttle pedal data 204).

The filter factor 610 may be determined based on a mean throttle error 608, which in turn may be based on a throttle error 606. The throttle error 606 may include one or more data points that reflect a difference between one or more throttle pedal positions in the throttle pedal data 204 and one or more respective throttle pedal positions at a corresponding point in time in a filtered throttle pedal data 604. Since each throttle pedal position in the throttle pedal data 204 may be a greater, equal, or lesser value than the respective throttle pedal position in the filtered throttle pedal data 604, the data in the throttle error 606 for that point in time may be a positive, zero, or negative value. The filtered throttle pedal data 604 may be determined by heavily filtering the throttle pedal data 204. In an aspect, the filtered throttle pedal data 604 may be determined by inputting the throttle pedal data 204 into a low-pass filter. Recalling that the throttle pedal data 204 may be embodied as a signal, the determination of the throttle error 606 may include a comparison of the throttle pedal position signal of the throttle pedal data 204 and the throttle pedal position signal of the filtered throttle pedal data 604. The resulting throttle error 606 may be similarly embodied as a throttle error signal.

The mean throttle error 608 may be determined based on the throttle error 606. The mean throttle error 608 may be determined according to a mathematical mean of the data points comprising the throttle error 606. In an aspect in which the throttle error 606 is embodied as a throttle error signal, the determination of the mean throttle error 608 may include an integration operation in which the—positive or negative—area(s) bound by the throttle error signal of the throttle error 606 and the "0" throttle error axis are determined for a particular time interval. The determination may further include a mathematical sum and/or mean of the areas. Appreciating that the mathematical sum and/or mean of the areas and/or data points may be a negative value, the sum and/or mean may be converted to an absolute value.

The filter factor 610 may be determined according to the mean throttle error 608 and/or the machine speed represented in the speed data 206. The filter factor 610 may be determined so that an increased degree of filtering of the throttle pedal data 204 is indicated by the filter factor 610 in proportion to the mean throttle error 608. To illustrate, if the mean throttle error 608 is zero (which may reflect one or more unintentional symmetrical throttle pedal oscillations), the filter factor 610 may indicate that a large degree of filtering of the throttle pedal data 204 is to occur. On the other hand, if the mean throttle error 608 is large, the filter factor 610 may indicate that no filtering or a minimal degree of filtering of the throttle pedal data 204 is to occur.

The filter factor 610 may additionally be determined so that an increased degree of filtering of the throttle pedal data 204 is indicated by the filter factor 610 in proportion to the machine speed reflected in the speed data 206. In an aspect, the faster that the machine 101 is moving, the more filtering of the throttle pedal data 204 is to occur. For example, if the machine 101 is not moving or moving at or near a minimum velocity for the machine 101, the filter factor 610 may indicate that no filtering or a minimal degree of filtering of the throttle pedal data 204 is to occur. Conversely, if the machine 101 is moving at or near a maximum velocity for the machine 101, the filter factor 610 may indicate that a large degree of filtering of the throttle pedal data 204 is to occur.

Figure 10:
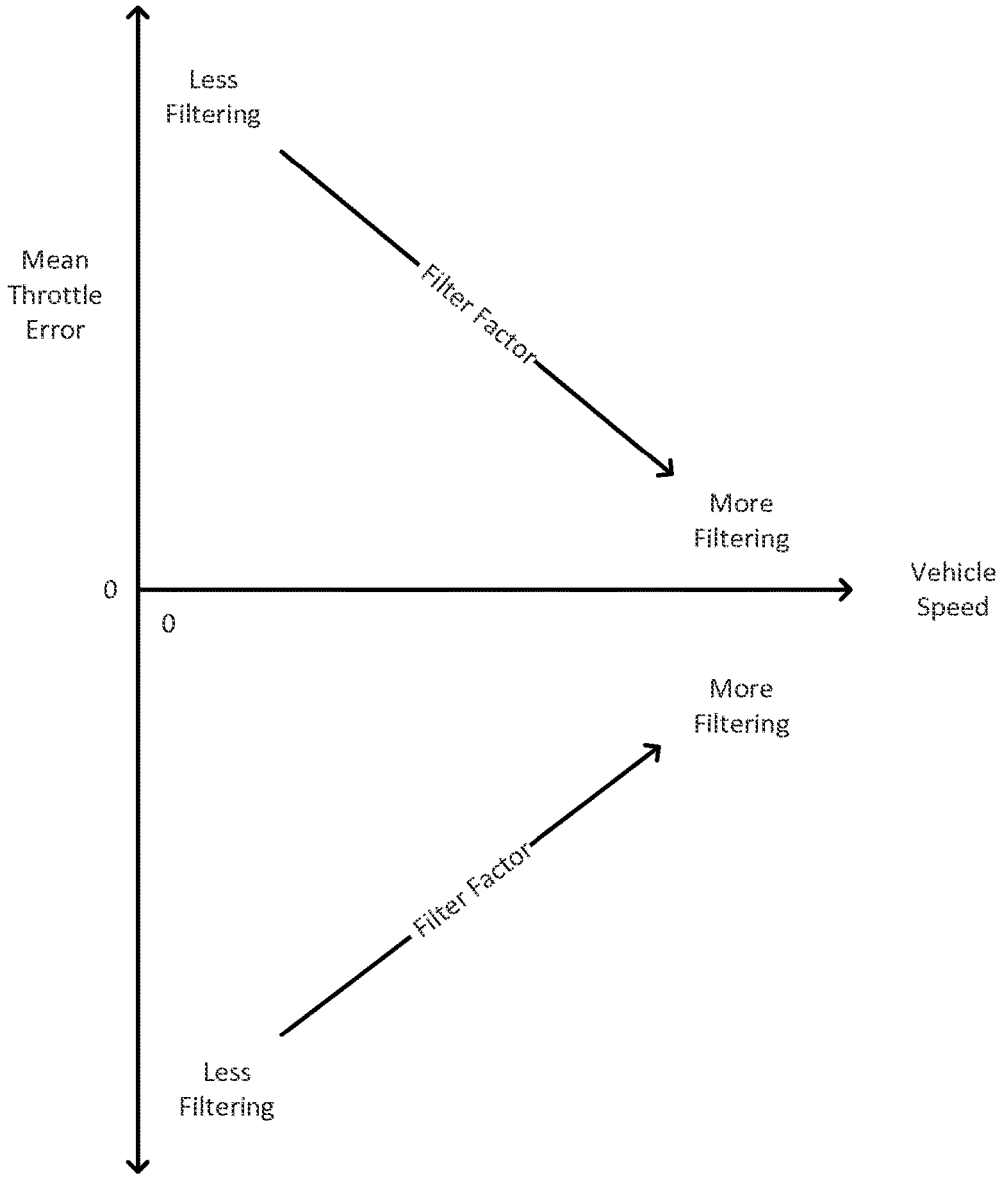
FIG. 10 illustrates a graph showing a methodology of determining a filter factor in accordance with aspects of the disclosure.

The filter factor 610 may be determined according to both the machine speed of the speed data 206 and the mean throttle error 608. FIG. 10 depicts a graph in which the mean throttle error 608 (which may be a positive or negate value, in some aspects) is plotted against the machine speed of the speed data 206 to determine the filter factor 610. As shown in FIG. 10, the degree of filtering indicated by the filter factor 610 is minimal when the mean throttle error 608 is significantly above or below zero (i.e., the absolute value of the mean throttle error 608 is high) and the machine speed of the speed data 206 is low. As the mean throttle error 608 approaches zero, the degree of filtering indicated by the filter factor 610 may increase. Similarly, as the machine speed of the speed data 206 increases, the degree of filtering indicated by the filter factor 610 may increase. Accordingly, when the mean throttle error 608 is zero or near zero and the machine speed of the speed data 206 is high, the filter factor 610 may indicate that a high or maximum degree of filtering is to occur.

In an aspect, the filter factor 610 may be additionally based on a special condition check 612. The special condition check 612 may include those features of the special condition check 212 described in reference to FIG. 2. Therefore, the filter factor 610 may indicate that no filtering or a minimal degree of filtering is to occur if one of the special conditions (e.g. light throttle pedal depression, heavy throttle pedal depression, or brake pedal depression) is determined.

The throttle pedal data 204 may be filtered by the filter 614 based on the filter factor 610. As previously noted, the filter factor 610 may indicate a condition, such as an undulating road, which may cause the operator to unintentionally cause symmetrical oscillations of the throttle pedal. As discussed above in relation to the filter 214 of FIG. 2, one or more data points of the throttle pedal data 204 representing throttle pedal positions or movements may be filtered (i.e., removed) from the throttle pedal data 204. The resultant data points of the throttle pedal data 204 that are not filtered from the throttle pedal data 204 may be referred to as the filtered throttle pedal data 620. The filtered throttle pedal data 620 may be transmitted to the engine 110 or component thereof, such as the controller 114 or the engine governor 112, to effectuate operation of the engine 110.

In order to effectuate the filtering process, the filter 614 may determine a first set of throttle pedal data from the throttle pedal data 204 and a second set of throttle pedal data from the throttle pedal data 204, wherein each data point of the throttle pedal data 204 is determined to be in either the first set of throttle pedal data or the second set of throttle pedal data. The first set of throttle pedal data (of which the filtered throttle pedal data 620 may comprise) may be transmitted to the engine 110, or a component thereof, while the second set of throttle pedal data may be discarded. The determination of the first and second sets of throttle pedal data may be based on the filter factor 610. As an example, if the filter factor 610 indicates that heavy filtering should be applied to the throttle pedal data 204 and the throttle pedal data 204 includes 100 data points, 75 of the data points of the throttle pedal data 204 may be determined to be in the second set of throttle pedal data and, therefore, 25 of the data points of the throttle pedal data 204 may be determined to be in the first set of throttle pedal data that is transmitted to the engine 110 as the filtered throttle pedal data 620. In other words, the 75 data points of the throttle pedal data 204 are filtered out and not passed to the engine 110. Conversely and by way of example, if the filter factor 610 indicates that minimal filtering should be applied to the throttle pedal data 204 and the throttle pedal data 204 includes 100 data points, 95 of the data points of the throttle pedal data 204 may be determined to be in the first set of throttle pedal data and transmitted to the engine 110 as the filtered throttle pedal data 620 and 5 data points of the throttle pedal data 204 may be determined to be in the second set of throttle pedal data and discarded.

Alternatively, or in combination with the above-described filtering process, the filtering process may be effectuated, for example, by modifying, such as by the filter 614, the throttle pedal data 204. The modification may be based on the filter factor 610. As an example, if the filter factor 610 indicates that the throttle pedal data 204 should be heavily filtered during a time interval due to a determination of a number of symmetrical oscillations of the throttle pedal reflected in the mean throttle error 608 for the time interval, one or more data points of the throttle pedal data 204 may be altered to represent a different throttle pedal position. The modified throttle pedal data may comprise the filtered throttle pedal data 620 and may be sent to the engine 110 to effectuate operation of the engine 110.

To provide a basic illustration, the throttle pedal data 204 may include a first, second, third, and fourth data point, each representing a throttle pedal position at sequential points of time. If the mean throttle error 608 indicates one or more symmetrical oscillations of the throttle pedal, such as symmetrical oscillations of the throttle pedal that may cause unintentional throttle pedal inputs by the operator, at the time points corresponding to the second and third data points, the second and/or third data points may be altered to reflect a different a different throttle pedal position. For example, the second and/or third data points may be each altered to equal the first data point or the fourth data point. As another example, the second and/or third data points may each be altered to comprise an average of any combination of the first, second, third, and/or fourth data points (e.g., the average of the first and fourth data points, the average of the first, second, third, and fourth data points, and so forth). As yet another example, the second and/or third data point may be altered to comprise an average, such as a rolling average, of the second and/or third data point, respectively, and a certain number of temporally preceding data points. The number of temporally preceding data points may be based on the filter factor 610. The average may be weighted based on the filter factor 610. The first data point, the altered second data point, the altered third data point, and the fourth data point may comprise the filtered throttle pedal data 620 and may be sent to the engine 110.

In an aspect, the filter 614 may include a low-pass filter in which throttle pedal movements embodied in the throttle pedal data 204 with frequencies above a corner frequency are attenuated or filtered out (i.e., are not included in the filtered throttle pedal data 220) and throttle pedal movements at or below the corner frequency are not filtered out (i.e., are included in the filtered throttle pedal data 620). The corner frequency may be determined according to the filter factor 610. In an example aspect, the corner frequency may be determined according to Table 1 above.

Figure 11:
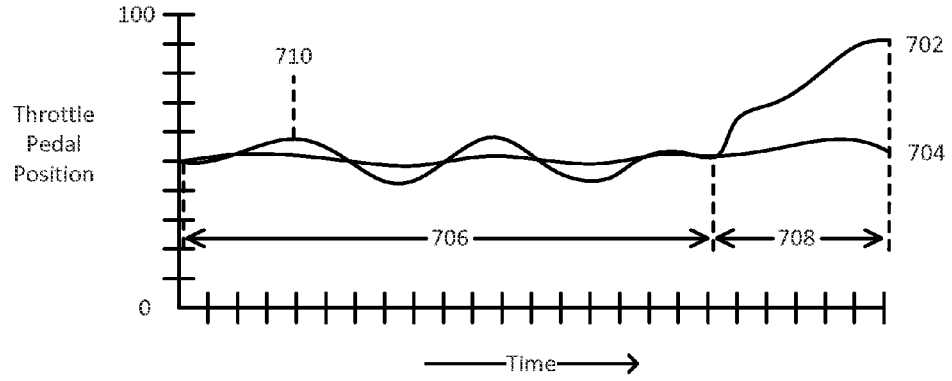
FIG. 11 illustrates a graph showing throttle pedal data in accordance with aspects of the disclosure.
Figure 12:
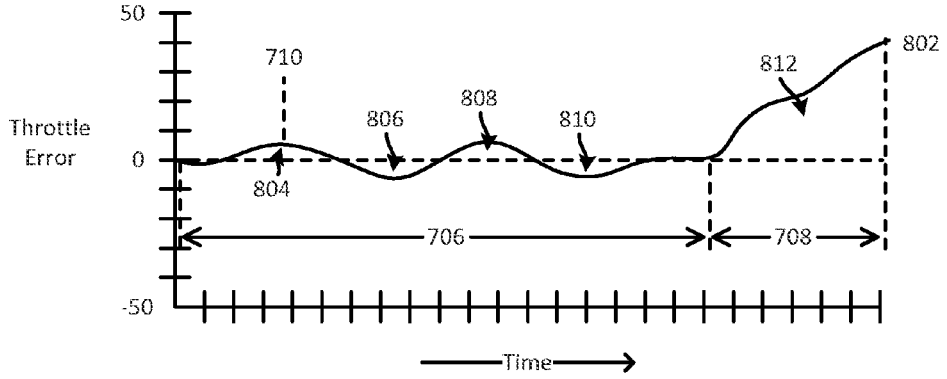
FIG. 12 illustrates a graph showing throttle error data in accordance with aspects of the disclosure.
Figure 13:
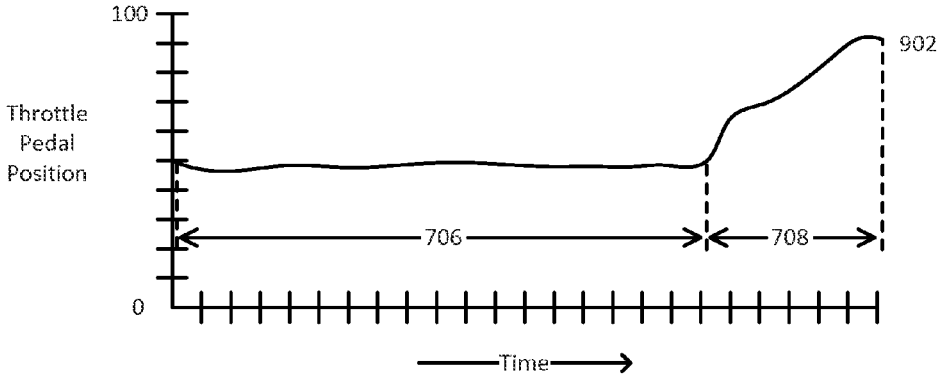
FIG. 13 illustrates a graph showing filtered throttle pedal data in accordance with aspects of the disclosure.

FIGS. 11-13 provide an example of throttle pedal data 204 filtering based, at least, on the mean throttle error 608. FIG. 11 depicts a graph in which a throttle pedal position signal 702, such as a signal embodying the throttle pedal data 204, is plotted according to throttle pedal position and time. During a time interval 706, several symmetrical oscillating movements of the throttle pedal are represented in the throttle pedal position signal 702. During a time interval 708, a large unidirectional throttle pedal movement is represented in the throttle pedal position signal 702. A filtered throttle pedal position signal 704, such as a signal embodying the filtered throttle pedal data 604, is also depicted in the graph of FIG. 11. The filtered throttle pedal position signal 704 is derived from the throttle pedal position signal 702 after the throttle pedal position signal 702 was filtered. In this case, the throttle pedal position signal 702 was heavily filtered such that the filtered throttle pedal position signal 704 is substantially flat.

FIG. 12 depicts a graph in which a throttle error signal 802, such as a signal embodying the throttle error 606, is plotted according to a throttle error value and time. In the graph, the axis for the zero throttle error value is shown for illustrative purposes as a dashed line. The throttle error signal 802 may be determined by comparing the throttle pedal position signal 702 and the filtered throttle pedal position signal 704 of FIG. 11 and determining a difference between the throttle pedal position signal 702 and the filtered throttle pedal position signal 704. The difference between the throttle pedal position signal 702 and the filtered throttle pedal position signal 704 may comprise the throttle error signal 802. For example, the difference between the throttle pedal position of the throttle pedal position signal 702 at time 710 and the throttle pedal position of the filtered throttle pedal position signal 704 at time 710 may comprise the throttle error value of the throttle error signal 802 at time 710.

FIG. 13 depicts a graph in which a filtered throttle position signal 902, such as a signal embodying the filtered throttle pedal data 620, is plotted according to throttle pedal position and time. The filtered throttle position signal 902 may be determined by filtering the throttle pedal position signal 702 of FIG. 11 according to a filter factor, such as the filter factor 610, for each of the time intervals 706 and 708. The filter factors may be determined based on the mean throttle error, such as the mean throttle error 608, of the throttle error signal 802.

The mean throttle error of the throttle error signal 802 for the time interval 706 may be determined by a mathematical sum and/or mean of the areas bound by the throttle error signal 802 and the axis for the zero throttle error value, namely areas 804, 806, 808, and 810. Noting that areas 806 and 810 are below the axis for the zero throttle error value and therefore are considered negative areas, the sum and/or mean of the areas 804, 806, 808, 810 is about zero. Therefore, the mean throttle error for the time interval 706 is about zero. Since the mean throttle error for the time interval 706 is close to zero, the filter factor for the time interval 706 indicates that the throttle pedal position signal 702 is to be filtered to a large degree. As can be seen in the filtered throttle position signal 902 in FIG. 13, the several substantially symmetrical oscillations in the throttle pedal position signal 702 during the time interval 706, which may represent unintentional movements of the throttle pedal by the operator, are filtered out (i.e., those data points in the throttle pedal data are removed) and the filtered throttle position signal 902 is substantially flat.

The mean throttle error of the throttle error signal 802 for the time interval 708 may similarly be determined by a mathematical sum and/or mean of the area(s) within the time interval bound by the throttle error signal 802 and the axis for the zero throttle error value. In particular, the area 812 is considered for determining the mean throttle error for the time interval 708. Since the area 812 comprises a substantial area, the mean throttle area for the time interval 708 is similarly large. Since the mean throttle area for time interval 708 is large (i.e., not close to zero), particularly in comparison to the mean throttle error for time interval 706, the filter factor for the time interval 706 indicates that the throttle pedal position signal 702 is to be minimally filtered or not filtered at all. As can be seen in the filtered throttle position signal 902 in FIG. 13, the large unidirectional movement in the throttle pedal position signal 702 during the time interval 708 is substantially unfiltered. The filtered throttle position signal 902 may be transmitted to the engine 110 or component thereof, such as the controller 114 or the engine governor 112.

It will be appreciated that a time delay may be introduced in the filtering process, such as a time delay caused by the transmitting, processing, and/or filtering of data (e.g., the throttle pedal data 204, and/or the speed data 206). For example, instead of the throttle pedal position signal 702 being filtered, as shown in FIG. 13, during the time interval 706 or the time interval 708, the throttle pedal position signal 702 may instead be filtered during a later time interval (e.g., the start of the time interval is shifted to the right of the time interval 706 or the time interval 708 in the graph of FIG. 13) due to the processing time required to determine a filter factor on which the filtering may be based.

Figure 14:
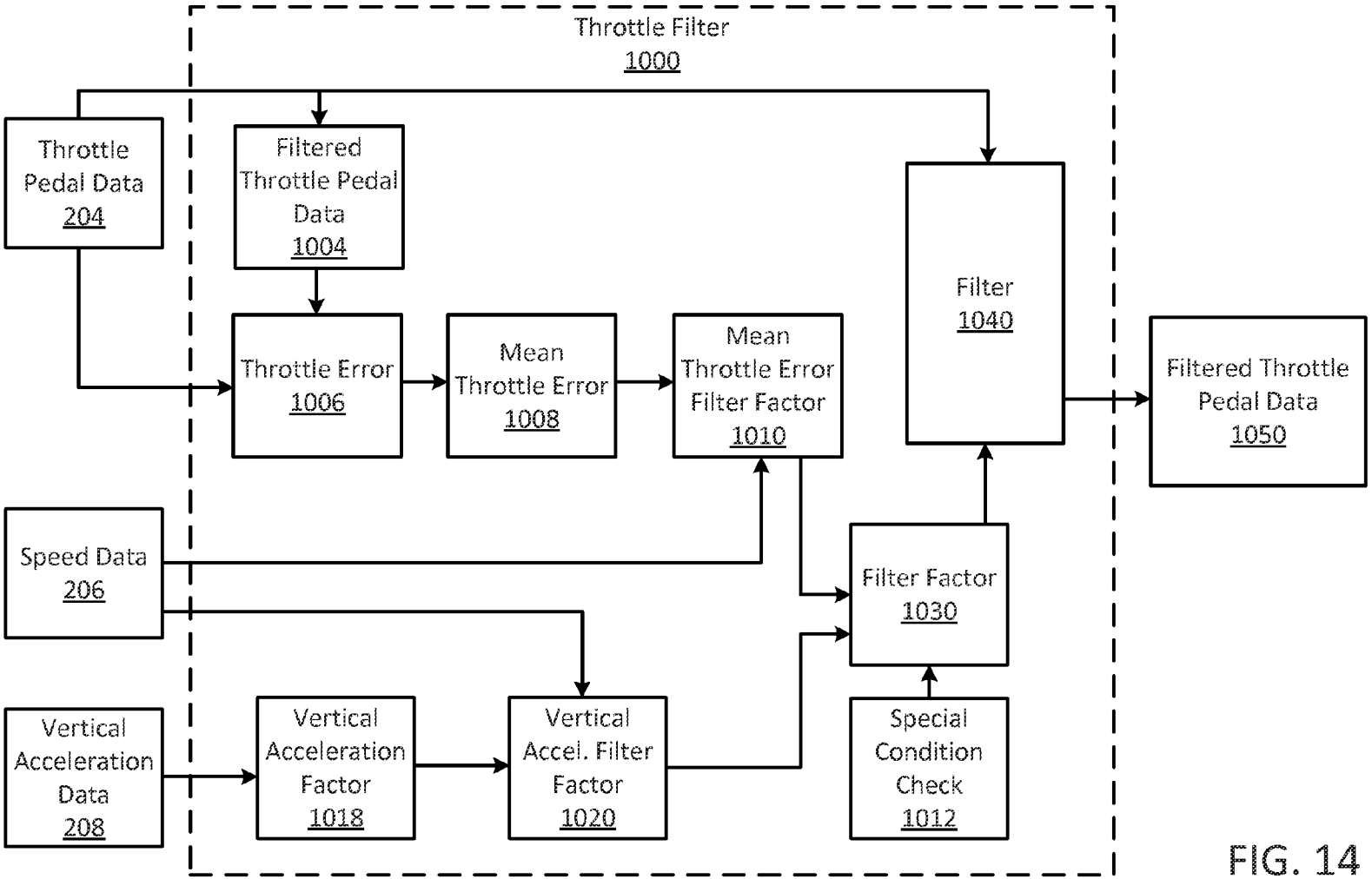
FIG. 14 illustrates a block diagram of an exemplary data flow in accordance with aspects of the disclosure.

FIG. 14 depicts an example flow diagram of various operations relating to systems and methods of adaptive throttle filtering. A throttle filter 1000 may combine some filtering aspects of the throttle filter 200 of FIG. 2 and the throttle filter 600 of FIG. 9. In general, the throttle filter 1000 may determine that one or more vertical accelerations have occurred which may have caused unintentional throttle pedal movement and/or determine that there have been one or more unintentional symmetrical oscillations of the throttle pedal. If either or both of the conditions are determined to exist, the throttle pedal data 204 may be filtered accordingly. The throttle filter 1000 may be implemented in the throttle filter module 102.

As discussed in reference to FIG. 2, the throttle pedal data 204 may include data representing one or more positions and/or movements of the throttle pedal and may be received from the throttle pedal sensor 104. As shown in FIG. 3, the throttle pedal data 204 may be include a plurality of sequential data points, each representing a position of the throttle pedal at a point in time. The throttle pedal data 204 may be represented as a signal, as shown in FIG. 4.

Also as discussed in reference to FIG. 2, the speed data 206 may include data representing the speed of the machine 101 and may be received from the speed sensor 106.

The throttle pedal data 204 may be filtered by a filter 1040 based on a filter factor 1030. As with other types of filter factors described herein, the filter factor 1030 may represent the existence of a condition in which the one or more unintentional throttle pedal movements may occur or have occurred and, thus, it may be desirable to filter out the data representing those throttle pedal movements from the throttle pedal data 204. In an aspect, the filter factor 1030 may be represented by a value from 0 to 1, wherein a value of 1 indicates that no or minimal filtering of the throttle pedal data 204 is to occur (i.e., no or minimal data representing positions and/or movements of the throttle pedal are filtered out from the throttle pedal data 204) and a value of 0 indicates that the throttle pedal data 204 is to be filtered to a maximum degree (i.e., a large amount of data representing positions and/or movements of the throttle pedal are filtered out from the throttle pedal data 204).

The filter factor 1030 may be determined based, at least, on a mean throttle error filter factor 1010 and/or a vertical acceleration filter factor 1020. In an aspect, the filter factor 1030 may be determined by an analysis of the mean throttle error filter factor 1010 and the vertical acceleration filter factor 1020. If either the mean throttle error filter factor 1010 or the vertical acceleration filter factor 1020 indicates that the throttle pedal data 204 is to be filtered according to certain respective parameters, the filter factor 1030 may similarly indicate that the throttle pedal data 204 is to be filtered accordingly to one of those parameters. In an aspect, the filter factor 1030 may indicate a degree of filtering according to the highest degree of filtering indicated in either the mean throttle error filter factor 1010 or the vertical acceleration filter factor 1020. For instance, if the mean throttle error filter factor 1010 indicates that the throttle pedal data 204 should be heavily filtered and the vertical acceleration filter factor 1020 indicates that the throttle pedal data 204 should be minimally filtered, the filter factor 1030 may indicate that the throttle pedal data 204 is to be heavily filtered (as indicated in the mean throttle error filter factor 1010).

The mean throttle error filter factor 1010 may be determined based, at least, on a mean throttle error 1008 and/or a machine speed of the speed data 206. The mean throttle error 1008, in turn, may be based, at least, on a throttle error 1006. The throttle error 1006 may be based on a comparison of a filtered throttle pedal data 1004 and the throttle pedal data 204 and a determination of a difference between the filtered throttle pedal data 1004 and the throttle pedal data 204. The mean throttle error filter factor 1010, the mean throttle error 1008, the throttle error 1006, and the filtered throttle pedal data 1004 are each respectively analogous to the filter factor 610, the mean throttle error 608, the throttle error 606, and the filtered throttle pedal data 604 of the throttle filter 600 of FIG. 9. Accordingly, the mean throttle error filter factor 1010, the mean throttle error 1008, the throttle error 1006, and the filtered throttle pedal data 1004 each may include those attributes of each respective counterpart of the throttle filter 600 of FIG. 9 and may be determined according to the methodology described in relation to each respective counterpart of the throttle filter 600 of FIG. 9.

The vertical acceleration filter factor 1020 may be determined based, at least, on a vertical acceleration factor 1018 and/or a machine speed of the speed data 206. The vertical acceleration factor 1018 may be determined based, at least, on the vertical acceleration data 208, which may be received from the vertical acceleration sensor 108. The vertical acceleration filter factor 1020 and the vertical acceleration factor 1018 are respectively analogous to the filter factor 210 and the vertical acceleration factor 218 of the throttle filter 200 of FIG. 2. Accordingly, the vertical acceleration filter factor 1020 and the vertical acceleration factor 1018 each may include those attributes of each respective counterpart of the throttle filter 200 of FIG. 2 and may be determined according to the methodology described in relation to each respective counterpart of the throttle filter 200 of FIG. 2.

In an aspect, the filter factor 1030 may be additionally based on a special condition check 1012. The special condition check 1012 may include those features of the special condition check 212 described in reference to FIG. 2 and the special condition check 612 described in reference to FIG. 9. Therefore, the filter factor 1030 may indicate that no filtering or a minimal degree of filtering is to occur if one of the special conditions (e.g. light throttle pedal depression, heavy throttle pedal depression, or brake pedal depression) is determined.

The throttle pedal data 204 may be filtered by the filter 1040 based on the filter factor 1030. As discussed above in relation to the filter 214 of FIG. 2 and filter 614 of FIG. 9, one or more data points of the throttle pedal data 204 representing throttle pedal positions or movements may be filtered out (i.e., removed) from the throttle pedal data 204. The resultant data points of the throttle pedal data 204 that are not filtered out from the throttle pedal data 204 may be referred to as the filtered throttle pedal data 1050. The filtered throttle pedal data 1050 may be transmitted to the engine 110 or component thereof, such as the controller 114 or the engine governor 112, to effectuate operation of the engine 110.

The filter 1040 is analogous to the filter 214 of the throttle filter 200 of FIG. 2 and the filter 614 of the throttle filter 600 of FIG. 2. Therefore, the filter 1040 may include those attributes of the filter 214 of the throttle filter 200 of FIG. 2 and/or the filter 614 of the throttle filter 600 of FIG. 9. The filtering methodology described in reference to the filter 214 of the throttle filter 200 of FIG. 2 and/or the filter 614 of the throttle filter 600 of FIG. 9 apply equally to the filtering methodology of the filter 1040.

INDUSTRIAL APPLICABILITY

The industrial applicability of the systems and methods for adaptive throttle filtering described herein will be readily appreciated from the foregoing discussion.

Figure 15:
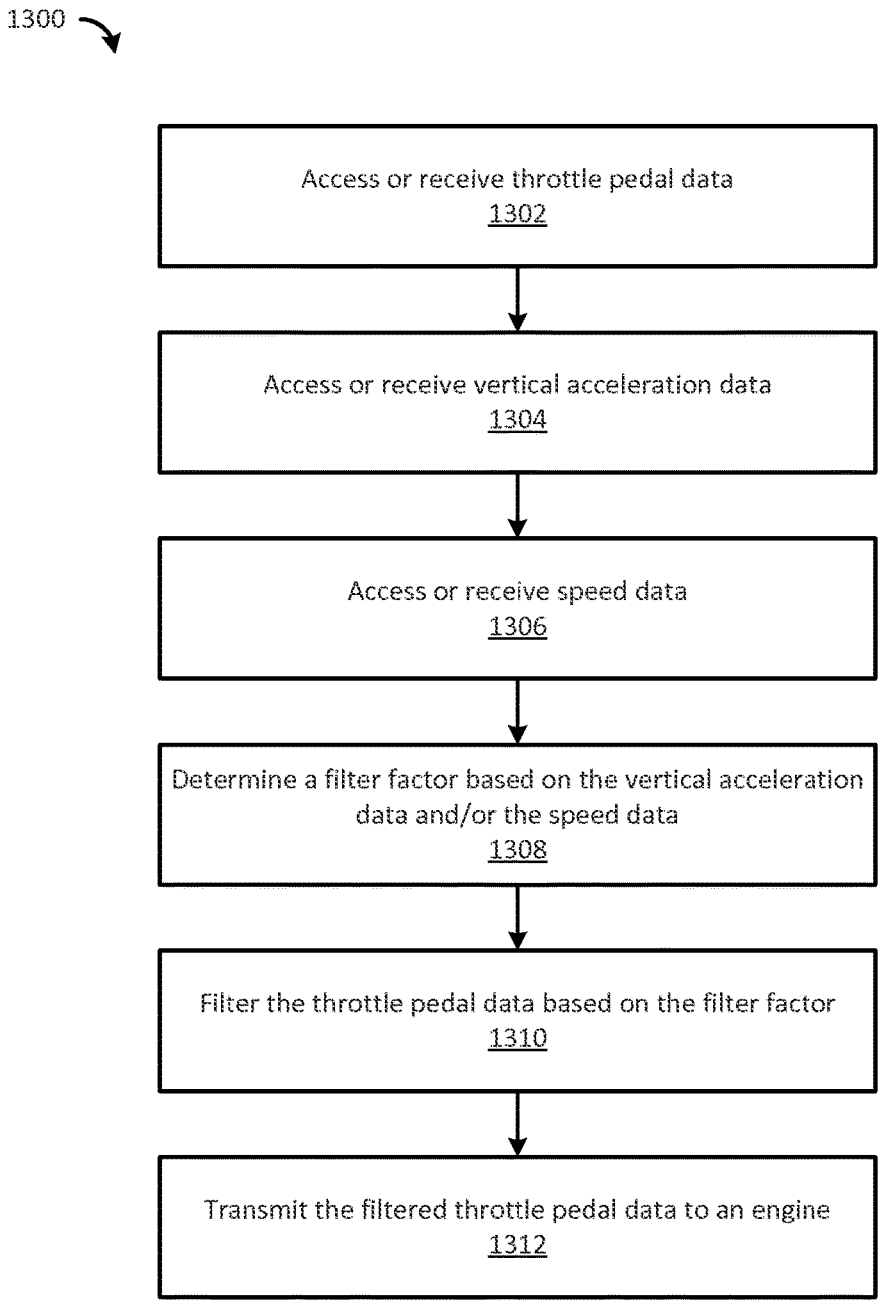
FIG. 15 illustrates a flow chart of an exemplary method in accordance with aspects of the disclosure.

FIG. 15 illustrates a process flow chart for a method 1300 for adaptive throttle filtering based, at least, on vertical acceleration data and/or speed data. For illustration, the operations of the method 1300 will be discussed in reference to FIGS. 1-5. At step 1302, throttle pedal data 204 may be accessed or received. The throttle pedal data 204 may be accessed or received by the throttle filter module 102 from the throttle pedal sensor 104. The throttle pedal data 204 may include data representing one or more positions and/or movements of the throttle pedal. The throttle pedal data 204 may include a plurality of sequential data points each representing a position of the throttle pedal at a corresponding point in time. The throttle pedal data 204 may additionally or alternatively be represented as a signal.

At step 1304, vertical acceleration data 208 may be accessed or received. The vertical acceleration data 208 may be received by the throttle filter module 102 from the vertical acceleration sensor 108. The vertical acceleration data 208 may include data representing one or more vertical accelerations of the machine 101, such as may be caused by the machine 101 driving over a bumpy road or loose terrain. The vertical acceleration data 208 may include a plurality of sequential data points, wherein each data point represents a magnitude of vertical acceleration of the machine 101 at a corresponding point in time. The vertical acceleration data 208 may additionally or alternatively be represented as a signal.

In an aspect, the vertical acceleration data 208 may be used to determine the vertical acceleration factor 218. The vertical acceleration factor 218 may reflect the frequency and/or magnitude of vertical accelerations indicated in the vertical acceleration data 208. For example, the vertical acceleration factor 218 may indicate that the machine 101 has undergone several large vertical accelerations that may have caused the operator to unintentionally depress and/or release the throttle pedal.

At step 1306, speed data 206 may be accessed or received. The speed data 206 may be accessed or received by the throttle filter module 102 from the speed sensor 106. The speed data 206 may include data representing the speed of the machine 101.

At step 1308, the filter factor 210 may be determined based on the vertical acceleration data 208 and/or the speed data 206. The filter factor 210 may represent the existence of conditions, such as a rough road or unstable terrain, in which it is desirable that the throttle pedal data 204, including one or more data points representing throttle pedal positions, be filtered or filtered to an increased degree. For example, if the vertical acceleration data 208 and/or the vertical acceleration factor 218 indicate several large vertical accelerations in a time interval, the filter factor 210 may indicate that the throttle pedal data 204 for that time interval is to be filtered to an increased degree. Conversely, if the vertical acceleration data 208 and/or the vertical acceleration factor 218 indicate little or no vertical accelerations in a time interval, the filter factor 210 may indicate that the throttle pedal data 204 for that time interval is to be filtered to a lesser degree.

Similarly, the filter factor 210 may be determined proportionally to the machine speed indicated in the speed data 206. That is, if the machine speed is high, the filter factor 210 may indicate that the throttle pedal data 204 is to be filtered to an increased degree. If the machine speed is low, the filter factor 210 may indicate that the throttle pedal data 204 is to be filtered to a lesser degree. The filter factor 210 may be determined by the throttle filter module 102.

In an aspect, the filter factor 210 may be additionally based on the special condition check 212. The special condition check 212 may determine if one of several special conditions exist, in which case the filter factor 210 may indicate that the throttle pedal data 204 is to be filtered to a minimal degree or not filtered at all. Example special conditions include the throttle pedal data 204 indicating a throttle pedal position of very low depression, the throttle pedal data 204 indicating a throttle pedal position of full or near full depression, or brake data indicating that the brake pedal is depressed.

At step 1310, the throttle pedal data 204 may be filtered, by the filter 214, based at least on the filter factor 210. The throttle pedal data 204 may be filtered by the throttle filter module 102. The filtering process may comprise filtering out (i.e., removing or discarding) one or more data points of the throttle pedal data 204 representing throttle pedal positions or movements. The data points of the throttle pedal data 204 that are not filtered out then comprise the filtered throttle pedal data 220. The filtered throttle pedal data 220 may be transmitted to the engine 110, or component thereof, to effectuate operation of the engine 110.

In an aspect, the filtering process may include determining, based at least on the filter factor 210, a first set of throttle pedal data from the throttle pedal data 204 and a second set of throttle pedal data from the throttle pedal data 204, wherein each data point of the throttle pedal data 204 is determined to be in either the first set of throttle pedal data or the second set of throttle pedal data. The first set of throttle pedal data (of which the filtered throttle pedal data 220 may comprise) may be transmitted to the engine 110, or a component thereof, while the second set of throttle pedal data may be discarded.

In an aspect, the filter 214 may include a low-pass filter in which throttle pedal movements embodied in the throttle pedal data 204 with frequencies above a corner frequency are attenuated or filtered out (i.e., are not included in the filtered throttle pedal data 220) and throttle pedal movements at or below the corner frequency are not filtered out (i.e., are included in the filtered throttle pedal data 220). The corner frequency may be determined according to the filter factor 210.

At step 1312, the filtered throttle pedal data 220 may be transmitted, such as by the throttle filter module 102, to the engine 110 or component thereof, such as the controller 114 or the engine governor 112. The filtered throttle pedal data 220 may be used by the engine 110 to effectuate operation of the engine 110, such as increasing the speed of the engine 110 and, therefore, the power output of the engine 110.

Figure 16:
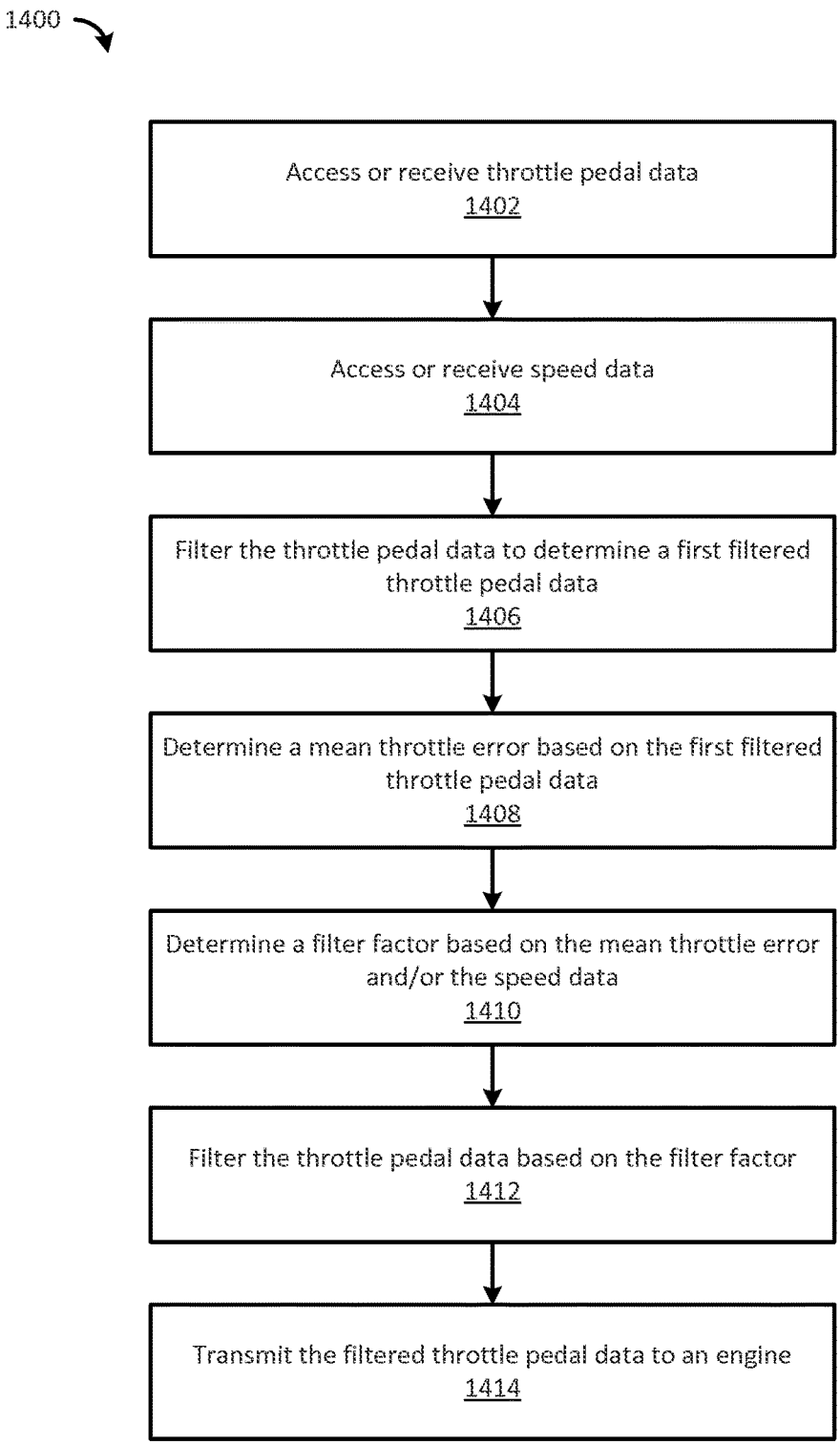
FIG. 16 illustrates a flow chart of an exemplary method in accordance with aspects of the disclosure.

FIG. 16 illustrates a process flow chart for a method 1400 for adaptive throttle filtering based, at least, on mean throttle error and/or speed data. For illustration, the operations of the method 1400 will be discussed in reference to FIGS. 1 and 9-13. At step 1402, throttle pedal data 204 may be accessed or received. The throttle pedal data 204 may be accessed or received by the throttle filter module 102 from the throttle pedal sensor 104. The throttle pedal data 204 may include data representing one or more positions and/or movements of the throttle pedal. The throttle pedal data 204 may include a plurality of sequential data points each representing a position of the throttle pedal at a corresponding point in time. The throttle pedal data 204 may additionally or alternatively be represented as a signal.

At step 1404, speed data 206 may be accessed or received. The speed data 206 may be accessed or received by the throttle filter module 102 from the speed sensor 106. The speed data 206 may include data representing the speed of the machine 101.

At step 1406, the throttle pedal data 204 may be filtered, such as by the throttle filter module 102, to determine a first filtered throttle pedal data, such as the filtered throttle pedal data 604. The filtered throttle pedal data 604 may be determined by heavily filtering the throttle pedal data 204. For example, most of the throttle pedal movements represented in the throttle pedal data 204 may be filtered out to determine the filtered throttle pedal data 604, such that the signal embodying the filtered throttle pedal data 604 is substantially flat. In an aspect, the filtered throttle pedal data 604 may be determined using a low-pass filter.

The filtered throttle pedal data 604 may be used to determine, such as by the throttle filter module 102, the throttle error 606. The throttle error 606 may include one or more data points that reflect a difference between one or more throttle pedal positions in the throttle pedal data 204 and one or more respective throttle pedal positions at a corresponding point in time in the filtered throttle pedal data 604. Determining the throttle error 606 may include comparing a signal, or portion thereof, embodying the throttle pedal data 204 and a signal, or portion thereof, embodying the filtered throttle pedal data 604 and determining a difference between the two signals, or a portions thereof.

At step 1408, the mean throttle error 608 may be determined based, at least, on the filtered throttle pedal data 604 and/or the throttle error 606 (which may be based, at least, on the filtered throttle pedal data 604). The mean throttle error 608 may be determined according to a mathematical mean of the data points comprising the throttle error 606. In an aspect in which the throttle error 606 is embodied as a throttle error signal, the determination of the mean throttle error 608 may include an integration operation in which the—positive or negative—area(s) bound by the throttle error signal of the throttle error 606 and the "0" throttle error axis are determined for a particular time interval. The determination may further include a mathematical sum and/or mean of the area(s).

At step 1410, the filter factor 610 may be determined based, at least, on the mean throttle error 608 and/or the speed data 206. The filter factor 610 may be determined by the throttle filter module 102. The filter factor 610 may be determined so that an increased degree of filtering of the throttle pedal data 204 is indicated by the filter factor 610 in proportion to the mean throttle error 608. For example, if the mean throttle error 608 is zero (which may reflect one or more unintentional symmetrical throttle pedal oscillations), the filter factor 610 may indicate that the throttle pedal data 204 is to be filtered to an increased degree. Conversely, if the absolute value of the mean throttle error 608 is large, the filter factor 610 may indicate that the throttle pedal data 204 is to be filtered to a lesser degree or not at all.

The filter factor 610 may be determined proportionally to the machine speed indicated in the speed data 206. That is, if the machine speed is high, the filter factor 610 may indicate that the throttle pedal data 204 is to be filtered to an increased degree. If the machine speed is low, the filter factor 610 may indicate that the throttle pedal data 204 is to be filtered to a lesser degree.

In an aspect, the filter factor 610 may be additionally based on the special condition check 612. The special condition check 612 may determine if one of several special conditions exist, in which case the filter factor 610 may indicate that the throttle pedal data 204 is to be filtered to a minimal degree or not filtered at all. Example special conditions include the throttle pedal data 204 indicating a throttle pedal position of very low depression, the throttle pedal data 204 indicating a throttle pedal position of full or near full depression, or brake data indicating that the brake pedal is depressed.

At step 1412, the throttle pedal data 204 may be filtered, by the filter 614, based at least on the filter factor 610. The throttle pedal data 204 may be filtered by the throttle filter module 102. The filtering process may comprise filtering out (i.e., removing or discarding) one or more data points of the throttle pedal data 204 representing throttle pedal positions or movements. The data points of the throttle pedal data 204 that are not filtered out may then comprise the filtered throttle pedal data 620. The filtered throttle pedal data 620 may be transmitted to the engine 110, or component thereof, to effectuate operation of the engine 110.

In an aspect, the filtering process may include determining, based at least on the filter factor 610, a first set of throttle pedal data from the throttle pedal data 204 and a second set of throttle pedal data from the throttle pedal data 204, wherein each data point of the throttle pedal data 204 is determined to be in either the first set of throttle pedal data or the second set of throttle pedal data. The first set of throttle pedal data (of which the filtered throttle pedal data 620 may comprise) may be transmitted to the engine 110, or a component thereof, while the second set of throttle pedal data may be discarded.

In an aspect, the filter 614 may include a low-pass filter in which throttle pedal movements embodied in the throttle pedal data 204 with frequencies above a corner frequency are attenuated or filtered out (i.e., are not included in the filtered throttle pedal data 620) and throttle pedal movements at or below the corner frequency are not filtered out (i.e., are included in the filtered throttle pedal data 220). The corner frequency may be determined according to the filter factor 610.

At step 1414, the filtered throttle pedal data 620 may be transmitted, such as by the throttle filter module 102, to the engine 110 or component thereof, such as the controller 114 or the engine governor 112. The filtered throttle pedal data 620 may be used by the engine 110 to effectuate operation of the engine 110, such as increasing the speed of the engine 110 and, therefore, the power output of the engine 110.

Figure 17:
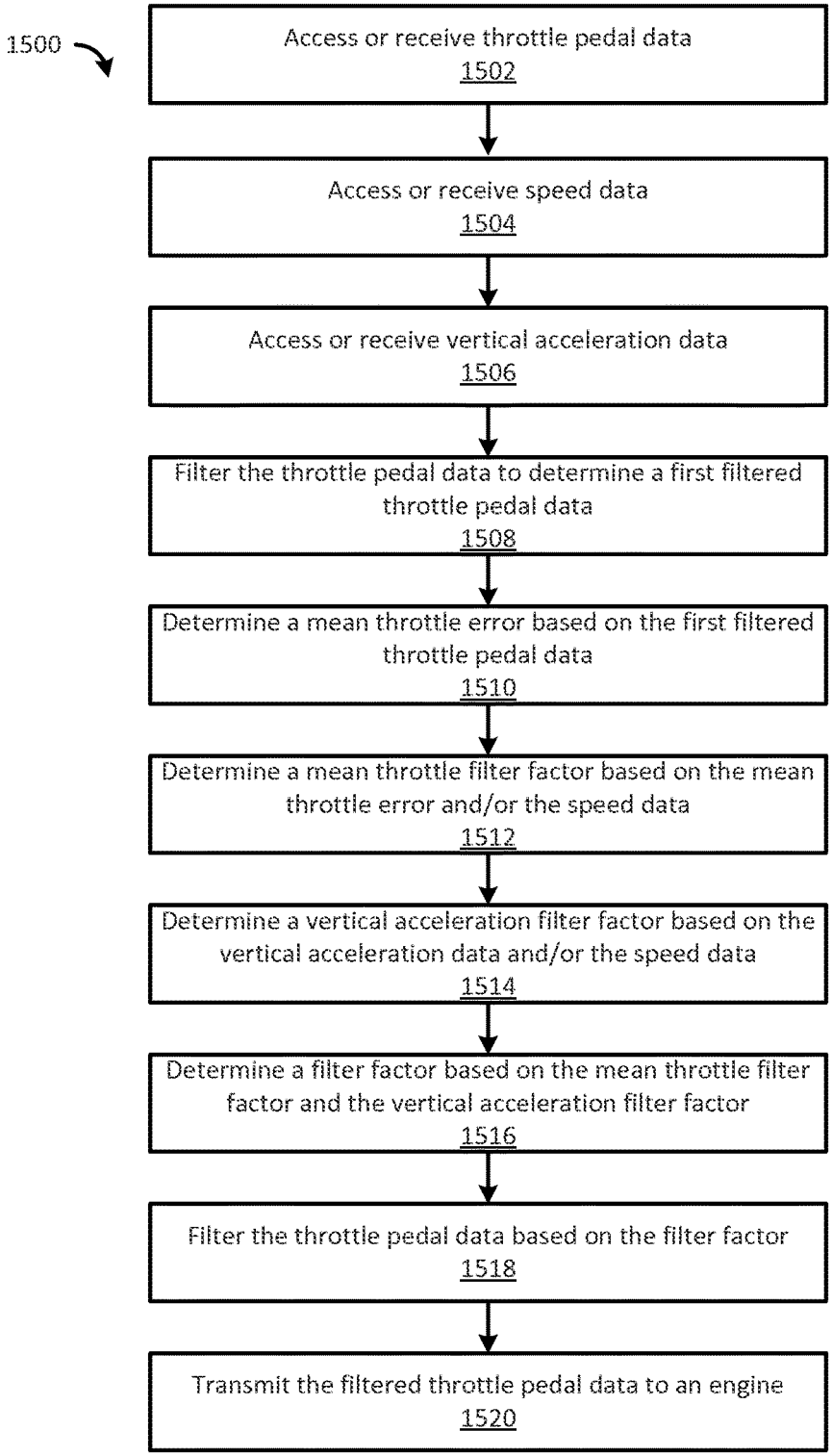
FIG. 17 illustrates a flow chart of an exemplary method in accordance with aspects of the disclosure.

FIG. 17 illustrates a process flow chart for a method 1500 for adaptive throttle filtering based, at least, on vertical acceleration data, mean throttle error, and/or speed data. For illustration, the operations of the method 1500 will be discussed in reference to FIGS. 1 and 14.

At step 1502, throttle pedal data 204 may be accessed or received. The throttle pedal data 204 may be accessed or received by the throttle filter module 102 from the throttle pedal sensor 104. The throttle pedal data 204 may include data representing one or more positions and/or movements of the throttle pedal. The throttle pedal data 204 may include a plurality of sequential data points each representing a position of the throttle pedal at a corresponding point in time. The throttle pedal data 204 may additionally or alternatively be represented as a signal.

At step 1504, speed data 206 may be accessed or received. The speed data 206 may be accessed or received by the throttle filter module 102 from the speed sensor 106. The speed data 206 may include data representing the speed of the machine 101.

At step 1506, vertical acceleration data 208 may be accessed or received. The vertical acceleration data 208 may be received by the throttle filter module 102 from the vertical acceleration sensor 108. The vertical acceleration data 208 may include data representing one or more vertical accelerations of the machine 101, such as may be caused by the machine 101 driving over a bumpy road or loose terrain. The vertical acceleration data 208 may include a plurality of sequential data points, wherein each data point represents a magnitude of vertical acceleration of the machine 101 at a corresponding point in time. The vertical acceleration data 208 may additionally or alternatively be represented as a signal.

In an aspect, the vertical acceleration data 208 may be used to determine the vertical acceleration factor 1018. The vertical acceleration factor 1018 may reflect the frequency and/or magnitude of vertical accelerations indicated in the vertical acceleration data 208. For example, the vertical acceleration factor 1018 may indicate that the machine 101 has undergone several large vertical accelerations that may have caused the operator to unintentionally depress and/or release the throttle pedal.

At step 1508, the throttle pedal data 204 may be filtered, such as by the throttle filter module 102, to determine a first filtered throttle pedal data, such as the filtered throttle pedal data 1004. The filtered throttle pedal data 1004 may be determined by heavily filtering the throttle pedal data 204. For example, most of the throttle pedal movements represented in the throttle pedal data 204 may be filtered out to determine the filtered throttle pedal data 1004, such that the signal embodying the filtered throttle pedal data 1004 is substantially flat. In an aspect, the filtered throttle pedal data 1004 may be determined using a low-pass filter.

The filtered throttle pedal data 1004 may be used to determine, such as by the throttle filter module 102, the throttle error 1006. The throttle error 1006 may include one or more data points that reflect a difference between one or more throttle pedal positions in the throttle pedal data 204 and one or more respective throttle pedal positions at a corresponding point in time in the filtered throttle pedal data 1004. Determining the throttle error 1006 may include comparing a signal, or portion thereof, embodying the throttle pedal data 204 and a signal, or portion thereof, embodying the filtered throttle pedal data 1004 and determining a difference between the two signals, or a portions thereof.

At step 1510, the mean throttle error 1008 may be determined based, at least, on the filtered throttle pedal data 1004 and/or the throttle error 1006 (which may be based, at least, on the filtered throttle pedal data 604). The mean throttle error 1008 may be determined according to a mathematical mean of the data points comprising the throttle error 1006. In an aspect in which the throttle error 1006 is embodied as a throttle error signal, the determination of the mean throttle error 1008 may include an integration operation in which the—positive or negative—area(s) bound by the throttle error signal of the throttle error 1006 and the "0" throttle error axis are determined for a particular time interval. The determination may further include a mathematical sum and/or mean of the area(s).

At step 1512, the mean throttle error filter factor 1010 may be determined based, at least, on the mean throttle error 1008 and/or the speed data 206. The mean throttle error filter factor 1010 may be determined by the throttle filter module 102. The mean throttle error filter factor 1010 may be determined so that an increased degree of filtering of the throttle pedal data 204 is indicated by the mean throttle error filter factor 1010 in proportion to the mean throttle error 1008. For example, if the mean throttle error 1008 is zero or about zero (which may reflect one or more unintentional symmetrical throttle pedal oscillations), the mean throttle error filter factor 1010 may indicate that the throttle pedal data 204 is to be filtered to an increased degree. Conversely, if the absolute value of the mean throttle error 1008 is large, the mean throttle error filter factor 1010 may indicate that the throttle pedal data 204 is to be filtered to a lesser degree or not at all.

The mean throttle error filter factor 1010 may be determined proportionally to the machine speed indicated in the speed data 206. That is, if the machine speed is high, the mean throttle error filter factor 1010 may indicate that the throttle pedal data 204 is to be filtered to an increased degree. If the machine speed is low, the mean throttle error filter factor 1010 may indicate that the throttle pedal data 204 is to be filtered to a lesser degree.

At step 1514, the vertical acceleration filter factor 1020 may be determined based on the vertical acceleration data 208 and/or the speed data 206. The vertical acceleration filter factor 1020 may represent the existence of conditions, such as a rough road or unstable terrain, in which it is desirable that the throttle pedal data 204, including one or more data points representing throttle pedal positions, be filtered or filtered to an increased degree. For example, if the vertical acceleration data 208 and/or the vertical acceleration factor 1018 indicate several large vertical accelerations in a time interval, the vertical acceleration filter factor 1020 may indicate that the throttle pedal data 204 for that time interval is to be filtered to an increased degree. Conversely, if the vertical acceleration data 208 and/or the vertical acceleration factor 1018 indicate little or no vertical accelerations in a time interval, the vertical acceleration filter factor 1020 may indicate that the throttle pedal data 204 for that time interval is to be filtered to a lesser degree.

The vertical acceleration filter factor 1020 may be determined proportionally to the machine speed indicated in the speed data 206. For example, if the machine speed is high, the vertical acceleration filter factor 1020 may indicate that the throttle pedal data 204 is to be filtered to an increased degree. If the machine speed is low, the vertical acceleration filter factor 1020 may indicate that the throttle pedal data 204 is to be filtered to a lesser degree. The vertical acceleration filter factor 1020 may be determined by the throttle filter module 102.

At step 1516, the filter factor 1030 may be determined, such as by the throttle filter module 102, based, at least, on the mean throttle error filter factor 1010 and/or the vertical acceleration filter factor 1020. The determination of the filter factor 1030 may include a selection of one of the mean throttle error filter factor 1010 and the vertical acceleration filter factor 1020. The value of the filter factor 1030 may accordingly be the value of the selected filter factor. In an aspect, the value of the filter factor 1030 may be determined to be the value of the mean throttle error filter factor 1010 or the vertical acceleration filter factor that indicates that the throttle pedal data 204 is to be filtered to the highest degree.

At step 1518, the throttle pedal data 204 may be filtered, by the filter 1040, based at least on the filter factor 1030. The throttle pedal data 204 may be filtered by the throttle filter module 102. The filtering process may comprise filtering out (i.e., removing or discarding) one or more data points of the throttle pedal data 204 representing throttle pedal positions or movements. The data points of the throttle pedal data 204 that are not filtered out may then comprise the filtered throttle pedal data 1050. The filtered throttle pedal data 1050 may be transmitted to the engine 110, or component thereof, to effectuate operation of the engine 110.

In an aspect, the filtering process may include determining, based at least on the filter factor 1030, a first set of throttle pedal data from the throttle pedal data 204 and a second set of throttle pedal data from the throttle pedal data 204, wherein each data point of the throttle pedal data 204 is determined to be in either the first set of throttle pedal data or the second set of throttle pedal data. The first set of throttle pedal data (of which the filtered throttle pedal data 1050 may comprise) may be transmitted to the engine 110, or a component thereof, while the second set of throttle pedal data may be discarded.

In an aspect, the filter 1040 may include a low-pass filter in which throttle pedal movements embodied in the throttle pedal data 204 with frequencies above a corner frequency are attenuated or filtered out (i.e., are not included in the filtered throttle pedal data 1050) and throttle pedal movements at or below the corner frequency are not filtered out (i.e., are included in the filtered throttle pedal data 1050). The corner frequency may be determined according to the filter factor 1030.

At step 1520, the filtered throttle pedal data 1050 may be transmitted, such as by the throttle filter module 102, to the engine 110 or component thereof, such as the controller 114 or the engine governor 112. The filtered throttle pedal data 1050 may be used by the engine 110 to effectuate operation of the engine 110, such as increasing the speed of the engine 110 and, therefore, the power output of the engine 110.

Whether such functionality is implemented as hardware or software depends upon the design constraints imposed on the overall system. Skilled persons may implement the described functionality in varying ways for each particular application, but such implementation decisions should not be interpreted as causing a departure from the scope of the disclosure. In addition, the grouping of functions within a module, block, or step is for ease of description. Specific functions or steps may be moved from one module or block without departing from the disclosure.

The various illustrative logical blocks and modules described in connection with the aspects disclosed herein may be implemented or performed with a general purpose processor, a digital signal processor (DSP), application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration.

The steps of a method or algorithm described in connection with the aspects disclosed herein may be embodied directly in hardware, in a software module executed by a processor (e.g., of a computer), or in a combination of the two. A software module may reside, for example, in RAM memory, flash memory, ROM memory, EPROM memory, EEPROM memory, registers, hard disk, a removable disk, a CD-ROM, or any other form of storage medium. An exemplary storage medium may be coupled to the processor such that the processor may read information from, and write information to, the storage medium. In the alternative, the storage medium may be integral to the processor. The processor and the storage medium may reside in an ASIC.

In at least some aspects, a processing system (e.g., the throttle filter module 102, the throttle pedal sensor 104, the speed sensor 106, the vertical acceleration sensor 108, the engine governor 112, or the controller 114) that implements a portion or all of one or more of the technologies described herein may include a general-purpose computer system that includes or is configured to access one or more computer-accessible media.

Figure 18:
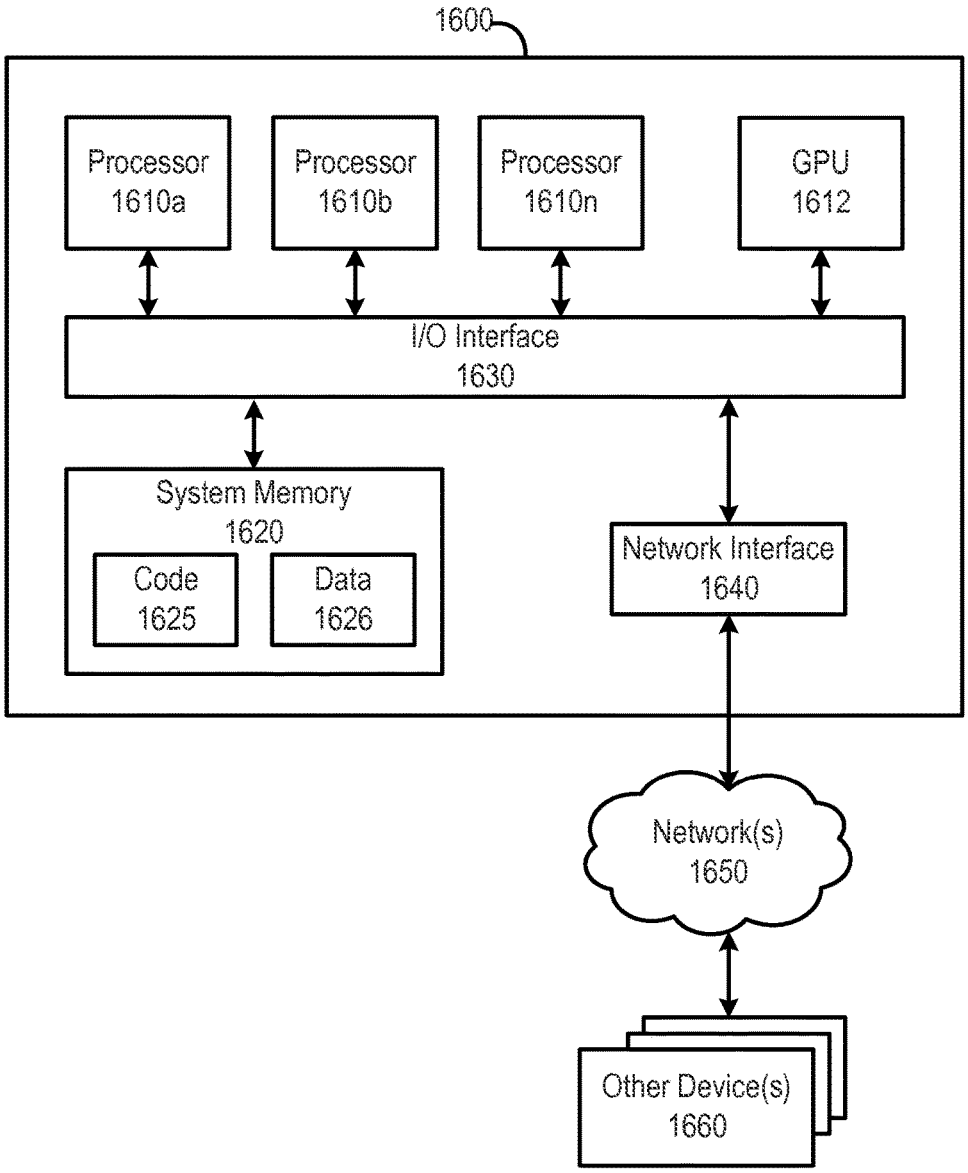
FIG. 18 illustrates a block diagram of a computer system configured to implement the methods illustrated by the flow charts of FIGS. 15-17.

FIG. 18 depicts a general-purpose computer system that includes or is configured to access one or more computer-accessible media. In the illustrated aspect, a computing device 1600 may include one or more processors 1610*a*, 1610*b*, and/or 1610*n* (which may be referred herein singularly as the processor 1610 or in the plural as the processors 1610) coupled to a system memory 1620 via an input/output (I/O) interface 1630. The computing device 1600 may further include a network interface 1640 coupled to an I/O interface 1630.

In various aspects, the computing device 1600 may be a uniprocessor system including one processor 1610 or a multiprocessor system including several processors 1610 (e.g., two, four, eight, or another suitable number). The processors 1610 may be any suitable processors capable of executing instructions. For example, in various aspects, the processor(s) 1610 may be general-purpose or embedded processors implementing any of a variety of instruction set architectures (ISAs), such as the x86, PowerPC, SPARC, or MIPS ISAs, or any other suitable ISA. In multiprocessor systems, each of the processors 1610 may commonly, but not necessarily, implement the same ISA.

In some aspects, a graphics processing unit ("GPU") 1612 may participate in providing graphics rendering and/or physics processing capabilities. A GPU may, for example, include a highly parallelized processor architecture specialized for graphical computations. In some aspects, the processors 1610 and the GPU 1612 may be implemented as one or more of the same type of device.

The system memory 1620 may be configured to store instructions and data accessible by the processor(s) 1610. In various aspects, the system memory 1620 may be implemented using any suitable memory technology, such as static random access memory ("SRAM"), synchronous dynamic RAM ("SDRAM"), nonvolatile/Flash®-type memory, or any other type of memory. In the illustrated aspect, program instructions and data implementing one or more desired functions, such as those methods, techniques and data described above, are shown stored within the system memory 1620 as code 1625 and data 1626.

In one aspect, the I/O interface 1630 may be configured to coordinate I/O traffic between the processor(s) 1610, the system memory 1620 and any peripherals in the device, including a network interface 1640 or other peripheral interfaces. In some aspects, the I/O interface 1630 may perform any necessary protocol, timing or other data transformations to convert data signals from one component (e.g., the system memory 1620) into a format suitable for use by another component (e.g., the processor 1610). In some aspects, the I/O interface 1630 may include support for devices attached through various types of peripheral buses, such as a variant of the Peripheral Component Interconnect (PCI) bus standard or the Universal Serial Bus (USB) standard, for example. In some aspects, the function of the I/O interface 1630 may be split into two or more separate components, such as a north bridge and a south bridge, for example. Also, in some aspects some or all of the functionality of the I/O interface 1630, such as an interface to the system memory 1620, may be incorporated directly into the processor 1610.

The network interface 1640 may be configured to allow data to be exchanged between the computing device 1600 and other device or devices 1660 attached to a network or networks 1650, such as other computer systems or devices, for example. In various aspects, the network interface 1640 may support communication via any suitable wired or wireless general data networks, such as types of Ethernet networks, for example. Additionally, the network interface 1640 may support communication via telecommunications/telephony networks, such as analog voice networks or digital fiber communications networks, via storage area networks, such as Fibre Channel SANs (storage area networks), or via any other suitable type of network and/or protocol.

In some aspects, the system memory 1620 may be one aspect of a computer-accessible medium configured to store program instructions and data as described above for implementing aspects of the corresponding methods and apparatus. However, in other aspects, program instructions and/or data may be received, sent, or stored upon different types of computer-accessible media. Generally speaking, a computer-accessible medium may include non-transitory storage media or memory media, such as magnetic or optical media, e.g., disk or DVD/CD coupled to computing device the 1600 via the I/O interface 1630. A non-transitory computer-accessible storage medium may also include any volatile or non-volatile media, such as RAM (e.g., SDRAM, DDR SDRAM, RDRAM, SRAM, etc.), ROM, etc., that may be included in some aspects of the computing device 1600 as the system memory 1620 or another type of memory. Further, a computer-accessible medium may include transmission media or signals, such as electrical, electromagnetic or digital signals, conveyed via a communication medium, such as a network and/or a wireless link, such as those that may be implemented via the network interface 1640. Portions or all of multiple computing devices, such as those illustrated in FIG. 18, may be used to implement the described functionality in various aspects; for example, software components running on a variety of different devices and servers may collaborate to provide the functionality. In some aspects, portions of the described functionality may be implemented using storage devices, network devices or special-purpose computer systems, in addition to or instead of being implemented using general-purpose computer systems. The term "computing device," as used herein, refers to at least all these types of devices and is not limited to these types of devices.

It should also be appreciated that the systems in the figures are merely illustrative and that other implementations might be used. Additionally, it should be appreciated that the functionality disclosed herein might be implemented in software, hardware, or a combination of software and hardware. Other implementations should be apparent to those skilled in the art. It should also be appreciated that a server, gateway, or other computing node may include any combination of hardware or software that may interact and perform the described types of functionality, including without limitation desktop or other computers, database servers, network storage devices and other network devices, PDAs, tablets, cellphones, wireless phones, pagers, electronic organizers, Internet appliances, and various other consumer products that include appropriate communication capabilities. In addition, the functionality provided by the illustrated modules may in some aspects be combined in fewer modules or distributed in additional modules. Similarly, in some aspects the functionality of some of the illustrated modules may not be provided and/or other additional functionality may be available.

Each of the operations, processes, methods, and algorithms described in the preceding sections may be embodied in, and fully or partially automated by, code modules executed by at least one computer or computer processors. The code modules may be stored on any type of non-transitory computer-readable medium or computer storage device, such as hard drives, solid state memory, and/or optical disc. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto may be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example aspects. The example systems and components described herein may be configured differently than described. For example, elements may be added to, removed from, or rearranged compared to the disclosed example aspects.

It will also be appreciated that various items are illustrated as being stored in memory or on storage while being used, and that these items or portions of thereof may be transferred between memory and other storage devices for purposes of memory management and data integrity. Alternatively, in other aspects some or all of the software modules and/or systems may execute in memory on another device and communicate with the illustrated computing systems via inter-computer communication. Furthermore, in some aspects, some or all of the systems and/or modules may be implemented or provided in other ways, such as at least partially in firmware and/or hardware, including, but not limited to, at least one application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the modules, systems and data structures may also be stored (e.g., as software instructions or structured data) on a computer-readable medium, such as a hard disk, a memory, a network, or a portable media article to be read by an appropriate drive or via an appropriate connection. The systems, modules, and data structures may also be transmitted as generated data signals (e.g., as part of a carrier wave or other analog or digital propagated signal) on a variety of computer-readable transmission media, including wireless-based and wired/cable-based media, and may take a variety of forms (e.g., as part of a single or multiplexed analog signal, or as multiple discrete digital packets or frames). Such computer program products may also take other forms in other aspects. Accordingly, the disclosure may be practiced with other computer system configurations.

Conditional language used herein, such as, among others, "may," "could," "might," "may," "e.g.," and the like, unless specifically stated otherwise, or otherwise understood within the context as used, is generally intended to convey that certain aspects include, while other aspects do not include, certain features, elements, and/or steps. Thus, such conditional language is not generally intended to imply that features, elements, and/or steps are in any way required for at least one aspects or that at least one aspects necessarily include logic for deciding, with or without author input or prompting, whether these features, elements, and/or steps are included or are to be performed in any particular aspect. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While certain example aspects have been described, these aspects have been presented by way of example only, and are not intended to limit the scope of aspects disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of aspects disclosed herein. The accompanying claims and their equivalents are intended to cover such forms or modifications as would fall within the scope and spirit of certain aspects disclosed herein.

The preceding detailed description is merely exemplary in nature and is not intended to limit the disclosure or the application and uses of the disclosure. The described aspects are not limited to use in conjunction with a particular type of machine. Hence, although the present disclosure, for convenience of explanation, depicts and describes particular machine, it will be appreciated that the assembly and electronic system in accordance with this disclosure may be implemented in various other configurations and may be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The disclosure may include communication channels that may be any type of wired or wireless electronic communications network, such as, e.g., a wired/wireless local area network (LAN), a wired/wireless personal area network (PAN), a wired/wireless home area network (HAN), a wired/wireless wide area network (WAN), a campus network, a metropolitan network, an enterprise private network, a virtual private network (VPN), an internetwork, a backbone network (BBN), a global area network (GAN), the Internet, an intranet, an extranet, an overlay network, a cellular telephone network, a Personal Communications Service (PCS), using known protocols such as the Global System for Mobile Communications (GSM), CDMA (Code-Division Multiple Access), Long Term Evolution (LTE), W-CDMA (Wideband Code-Division Multiple Access), Wireless Fidelity (Wi-Fi), and/or Bluetooth, and/or a combination of two or more thereof.

Additionally, the various aspects of the disclosure may be implemented in a non-generic computer implementation. Moreover, the various aspects of the disclosure set forth herein improve the functioning of the system as is apparent from the disclosure hereof. Furthermore, the various aspects of the disclosure involve computer hardware that it specifically programmed to solve the complex problem addressed by the disclosure. Accordingly, the various aspects of the disclosure improve the functioning of the system overall in its specific implementation to perform the process set forth by the disclosure and as defined by the claims.

Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context.

We claim:

1. A method comprising:

receiving vertical acceleration data indicative of a plurality of vertical accelerations of a machine;

receiving first throttle pedal data indicative of a plurality of throttle pedal movements;

receiving speed data indicative of a speed of the machine;

determining a filter factor based the vertical acceleration data and the speed data;

filtering the first throttle pedal data, based at least on the filter factor, to determine second throttle pedal data; and causing the second throttle pedal data to be transmitted to a controller to effectuate control of an operation of an engine.

2. The method of claim 1, wherein the second throttle pedal data comprises data indicative of a first set of throttle pedal movements from the plurality of throttle pedal movements and the filtering the first throttle pedal data comprises:

determining, based at least on the filter factor, the second throttle pedal data and third throttle pedal data indicative of a second set of throttle pedal movements from the plurality of throttle pedal movements, wherein the third throttle pedal data is not caused to be transmitted to the controller to effectuate control of the operation of the engine.

3. The method of claim 1, wherein the first throttle pedal data comprises a plurality of data points, the filtering the first throttle pedal data to determine the second throttle pedal data comprises:

modifying a data point of the plurality of data points, according to an average of a value of each of at least two or more data points of the plurality of data points, to determine the second throttle pedal data.

4. The method of claim 3, wherein the at least two or more data points of the plurality of data points comprises a number of data points temporally preceding the modified data point, the number of data points being based at least on the filter factor.

5. The method of claim 1, wherein the filter factor is proportional to a frequency of vertical accelerations of the plurality of vertical accelerations of the vertical acceleration data.

6. The method of claim 1, wherein the filter factor is proportional to the speed of the machine or the speed data.

7. A method comprising:

receiving first throttle pedal data indicative of a first plurality of throttle pedal movements;

filtering the first throttle pedal data to determine second throttle pedal data indicative of a second plurality of throttle pedal movements;

determining a throttle error based at least on a comparison of the first throttle pedal data to the second throttle pedal data, wherein the throttle error comprises a mean throttle error;

determining a filter factor based at least on the throttle error;

filtering the first throttle pedal data, based at least on the filter factor, to determine third throttle pedal data; and causing the third throttle pedal data to be transmitted to a controller to effectuate control of an operation of an engine.

8. The method of claim 7, wherein the third throttle pedal data comprises data indicative of a first set of throttle pedal movements from the first plurality of throttle pedal movements and the filtering the first throttle pedal data comprises:

determining, based at least on the filter factor, the third throttle pedal data and fourth throttle pedal data indicative of a second set of throttle pedal movements from the first plurality of throttle pedal movements, wherein the fourth throttle pedal data is not caused to be transmitted to the controller to effectuate control of the operation of the engine.

9. The method of claim 7, wherein the first throttle pedal data comprises a plurality of data points, the filtering the first throttle pedal data to determine the third throttle pedal data comprises:

modifying a data point of the plurality of data points, according to an average of a value of each of at least two or more data points of the plurality of data points, to determine the third throttle pedal data.

10. The method of claim 9, wherein the at least two or more data points of the plurality of data points comprises a number of data points temporally preceding the modified data point, the number of data points being based at least on the filter factor.

11. The method of claim 7, further comprising:

receiving speed data indicative of a speed of a machine, wherein the determining the filter factor is further based on the speed data.

12. The method of claim 7, wherein the filter factor is proportional to the mean throttle error.

13. A method comprising:

receiving first throttle pedal data indicative of a first plurality of throttle pedal movements;

receiving vertical acceleration data indicative of a plurality of vertical accelerations of a machine;

determining a vertical acceleration filter factor based at least on the vertical acceleration data;

filtering the first throttle pedal data to determine second throttle pedal data indicative of a second plurality of throttle pedal movements;

determining a throttle error based at least on a comparison of the first throttle pedal data and the second throttle pedal data;

determining a throttle error filter factor based at least on the throttle error;

determining a filter factor based at least on the throttle error filter factor and the vertical acceleration filter factor;

filtering the first throttle pedal data, based at least on the filter factor, to determine third throttle pedal data; and causing the third throttle pedal data to be transmitted to a controller to effectuate control of an operation of an engine.

14. The method of claim 13, wherein the third throttle pedal data comprises data indicative of a first set of throttle pedal movements from the first plurality of throttle pedal movements and the filtering the first throttle pedal data comprises:

determining, based at least on the filter factor, the third throttle pedal data and fourth throttle pedal data indicative of a second set of throttle pedal movements from the first plurality of throttle pedal movements, wherein the fourth throttle pedal data is not caused to be transmitted to the controller to effectuate control of the operation of the engine.

15. The method of claim 13, wherein the first throttle pedal data comprises a plurality of data points, the filtering the first throttle pedal data to determine the third throttle pedal data comprises:

modifying a data point of the plurality of data points, according to an average of a value of each of at least two or more data points of the plurality of data points, to determine the third throttle pedal data.

16. The method of claim 15, wherein the at least two or more data points of the plurality of data points comprises a number of data points temporally preceding the modified data point, the number of data points being based at least on the filter factor.

17. The method of claim 13, further comprising:

receiving speed data indicative of a speed of the machine, wherein the determining the vertical acceleration filter factor is further based on the speed data and the determining the throttle error filter factor is further based on the speed data.

18. The method of claim 13, wherein the throttle error comprises a mean throttle error.

* * * * *